US005822666A

United States Patent [19]

Haneda et al.

[11] Patent Number: 5,822,666

[45] Date of Patent: Oct. 13, 1998

[54] IMAGE FORMING APPARATUS INCLUDING A MECHANISM FOR ELIMINATING MECHANICAL SHOCK CAUSED BY A CLEANING DEVICE

[75] Inventors: Satoshi Haneda; Kunio Shigeta; Yotaro Sato; Tadayoshi Ikeda; Masakazu Fukuchi; Akitoshi Matsubara, all of Hachioji, Japan

[73] Assignee: Konica Corporation, Tokyo, Japan

[21] Appl. No.: 837,921

[22] Filed: Apr. 11, 1997

[30] Foreign Application Priority Data

| | | | |
|---|---|---|---|
| Apr. 19, 1996 | [JP] | Japan | 8-098165 |
| Jun. 20, 1996 | [JP] | Japan | 8-159757 |
| Jul. 17, 1996 | [JP] | Japan | 8-187281 |

[51] Int. Cl.[6] ..... G03G 15/00; G03G 15/01; G03G 15/14

[52] U.S. Cl. ..... 399/309; 399/101; 399/298; 399/390; 430/126

[58] Field of Search ..... 399/51, 66, 71, 399/98, 101, 298, 300, 309, 296, 364, 388, 390, 306, 303, 45; 430/126

[56] References Cited

U.S. PATENT DOCUMENTS

| | | | |
|---|---|---|---|
| 3,847,478 | 11/1974 | Young | 399/309 |
| 5,027,159 | 6/1991 | Oda et al. | 399/309 |
| 5,140,375 | 8/1992 | Shindo et al. | 399/66 X |
| 5,453,822 | 9/1995 | Anzai et al. | 399/299 |
| 5,510,885 | 4/1996 | Mori et al. | 399/298 X |
| 5,519,475 | 5/1996 | Miyamoto et al. | 399/308 |

FOREIGN PATENT DOCUMENTS

| | | |
|---|---|---|
| 49-37538 | 10/1974 | Japan . |
| 54-28740 | 9/1979 | Japan . |
| 64-44457 | 2/1989 | Japan . |
| 1-209470 | 8/1989 | Japan . |
| 7-072682 | 3/1995 | Japan . |

*Primary Examiner*—Arthur T. Grimley
*Assistant Examiner*—Sophia S. Chen
*Attorney, Agent, or Firm*—Frishauf, Holtz, Goodman, Langer & Chick

[57] ABSTRACT

An apparatus for forming an image on a sheet member includes a photoreceptor drum on which a first toner image and a second toner image are separately formed; an image carrying belt on which the second toner image is transferred from the photoreceptor drum; a first transfer device to transfer the first toner image from the photoreceptor drum to a first side of the sheet member; a second transfer device to transfer the second toner image from the image carrying belt to the other side of the sheet member; and a cleaner capable of being brought in contact with anal separated from the image carrying belt. The cleaner is brought in contact with the image carrying belt after the first toner image is transferred from the photoreceptor drum to the first side of the sheet member.

24 Claims, 19 Drawing Sheets

IMAGE FORMING APPARATUS INCLUDING A MECHANISM FOR ELIMINATING MECHANICAL SHOCK CAUSED BY A CLEANING DEVICE

BACKGROUND OF THE INVENTION

The present invention relates to an electrophotographic type image forming apparatus, in which an image is formed by transferring a toner image formed on an image carrier means, onto a transfer material, and by fixing the transfer material, in a copier, a printer, or a facsimile device. Specifically, the present invention relates to an image forming apparatus in which images are formed on both the obverse and reverse surfaces of the transfer material by transferring a toner image formed on a first image carrier means onto the obverse surface of the transfer material, next transferring the toner image formed on the first image carrier means onto a second image carrier means, and then transferring the image onto the reverse surface of the transfer material.

In a conventional double-sided image forming apparatus, the following method is adopted: an image, formed on an image carrier, is transferred onto and fixed on one side of a transfer material; the transfer material is temporarily accommodated in a double-surface reversal sheet feeding device; after that, the transfer material is sent from the double-surface reversal sheet feeding device in synchronization with an image, formed again on the image carrier; and the other image is transferred onto and fixed on the other side of the transfer material.

As described above, in this double-sided copying apparatus, the transfer material is conveyed in such a manner that it is sent to the double-surface reversal sheet feeding device, or is passed through a fixing device twice. Accordingly, conveyance reliability of the transfer material is low, and is often the cause of paper jams.

With respect to this, the following double sided image forming apparatus and double sided image forming method have been proposed in Japanese Patent Publication Nos. 37538/1974 and 28740/1979, and Japanese Patent Publication Open to Public Inspection Nos. 44457/1989, 209470/1992, etc., in which a toner image formed on the image carrier (the first image carrier means) is temporarily transferred onto the toner image receiving body (the second image carrier means); the toner image on the toner image receiving body is transferred onto the reverse surface of the transfer material; the toner image formed again on the image carrier is transferred onto the obverse surface of the transfer material; and both surfaces are simultaneously fixed so that images are formed on the both surfaces of the transfer material.

The present inventors researched the following double sided color image forming apparatus: a plurality of sets of charging means, image writing means, and developing means are provided corresponding to colors of Y, M, C and K; color toner images are formed by being superimposed on the image carrier during a single rotation; the superimposed color toner images are collectively transferred temporarily onto the toner image receiving body (the second image carrier means); the superimposed color toner images formed again on the image carrier, are transferred onto the obverse surface of the transfer material; and the both surfaces of the transfer material are simultaneously fixed, so that color images are formed on the both surfaces of the transfer material.

However, in the above double-sided image forming apparatus or the double-sided image forming method, mechanical shock, caused when a cleaning means for removing residual toner on the toner image receiving body, contacts the toner image receiving body or ends contact therewith, influences the image carrier, onto which the image is written by an image writing means, and thereby causes a problem, in that the image writing operation is disturbed. This results in an inferior image.

Further, as shown in FIG. 22 there is also a problem in that a toner accumulation is formed when the cleaning means comes into contact with the toner image receiving body or when the contact is released. Thus, when a toner image, which is a reverse surface image, is transferred onto the surface of the toner image receiving body, on which the toner accumulation is formed, an inferior image is obtained.

Still further, because the toner image receiving body and a fixing means for fixing the toner image transferred onto the transfer material are closely arranged with respect to each other, residue on the toner image receiving body fuses due to heat generated by the fixing means, and thereby, a toner image, which is a reverse surface image, is transferred onto the toner image receiving body onto which the residue is fused, resulting in an inferior image, which is also a problem.

SUMMARY OF THE INVENTION

An object of the present invention is to solve the above problems and to provide an image forming apparatus in which image writing is not disturbed by a mechanical shock, caused when a cleaning means comes into contact with the toner image receiving body or the contact is released, and a superior double-sided image is formed.

Another object of the present invention is to provide an image forming apparatus in which a toner image, which serves as a reverse surface image, is not transferred onto the surface of the toner image receiving body, on which a toner accumulated portion is formed, and thereby a superior image is formed.

Still another object of the present invention is to provide an image forming apparatus in which no residue is fused onto the toner image receiving body, and thereby, no toner image, which serves as a reverse image, is transferred onto the toner image receiving body onto which the residues are fused, so that a superior image is formed.

The above object can be attained by an image forming apparatus comprising: a first image carrier means to carry a toner image, formed on its surface by a toner image forming means; a second image carrier means onto which the toner image, carried on the first image carrier means, is transferred, and on the surface of which the transferred toner image is carried again; a first transfer means for transferring the toner image, carried on the first image carrier means, onto the obverse surface of a transfer material; a second transfer means for transferring the toner image, carried on the second image carrier means, onto the reverse surface of the transfer material; and a fixing means for transferring the toner images transferred onto both surfaces of the transfer material after the toner image, carried on the first image carrier means, is transferred onto the obverse surface of a transfer material by the first transfer means and the toner image, carried on the second image carrier means, is transferred onto the reverse surface of the transfer material by the second transfer means; the image forming apparatus characterized in that a cleaning means is provided which is opposed to the second image carrier means and which can contact with, and be removed from, it, and after the toner image on the first image carrier means has been transferred onto the transfer material by the first transfer means, the cleaning means comes into contact with the second image carrier means.

Further, the above object can be attained by an image forming apparatus comprising: a first image carrier means to carry a toner image, formed on its surface by a toner image forming means; a second image carrier means onto which the toner image, carried on the first image carrier means, is transferred, and on the surface of which the transferred toner image is carried again; a first transfer means for transferring the toner image, carried on the first image carrier means, onto the obverse surface of a transfer material; a second transfer means for transferring the toner image, carried on the second image carrier means, onto the reverse surface of the transfer material; and a fixing means for transferring the toner images transferred onto both surfaces of the transfer material after the toner image, carried on the first image carrier means, is transferred onto the obverse surface of a transfer material by the first transfer means and the toner image, carried on the second image carrier means, is transferred onto the reverse surface of the transfer material by the second transfer means; the image forming apparatus characterized in that a cleaning means is provided which is opposed to the second image carrier means and which can contact with, and be removed from, it, and after the toner image on the first image carrier means has been transferred onto the second image carrier means by the first transfer means, the contact of the cleaning means with the second image carrier means is released.

Still further, the above object can be attained by an image forming apparatus comprising: a first image carrier means to carry a toner image, formed on its surface by a toner image forming means; a second image carrier means onto which the toner image, carried on the first image carrier means, is transferred, and on the surface of which the transferred toner image is carried again; a first transfer means for transferring the toner image, carried on the first image carrier means, onto the obverse surface of a transfer material; a second transfer means for transferring the toner image, carried on the second image carrier means, onto the reverse surface of the transfer material; and a fixing means for transferring the toner images transferred onto both surfaces of the transfer material after the toner image, carried on the first image carrier means, is transferred onto the obverse surface of a transfer material by the first transfer means and the toner image, carried on the second image carrier means, is transferred onto the reverse surface of the transfer material by the second transfer means; the image forming apparatus characterized in that it has a transfer material charging means, which charges the transfer material to the same polarity as the charged polarity of the toner image formed on the first image carrier means, and as the charged polarity of the toner image on the second image carrier means, and in which the transfer material is charged to the same polarity as the toner by the transfer material charging means from above the toner image, formed on the second image carrier means; the transfer material is conveyed by the second image carrier means; the toner image on the first image carrier is transferred onto the obverse surface of the transfer material, when the bias voltage, having the different polarity, is applied through the second image carrier means, by the first transfer means; next, the second transfer means charges the obverse surface of the transfer material with the different polarity, and transfers the toner image on the second image carrier means onto the reverse surface of the transfer material.

Still further, the above object can be attained by an image forming apparatus comprising: a first image carrier means to carry a toner image, formed on its surface by a toner image forming means; a second image carrier means onto which the toner image, carried on the first image carrier means, is transferred, and on the surface of which the transferred toner image is carried again; a first transfer means for transferring the toner image, carried on the first image carrier means, onto the obverse surface of a transfer material; a second transfer means for transferring the toner image, carried on the second image carrier means, onto the reverse surface of the transfer material; and a fixing means for transferring the toner images transferred onto both surfaces of the transfer material after the toner image, carried on the first image carrier means, is transferred onto the obverse surface of a transfer material by the first transfer means and the toner image, carried on the second image carrier means, is transferred onto the reverse surface of the transfer material by the second transfer means; the image forming apparatus characterized in that a roller is provided which is rotated while being in contact with the second image carrier means; and an adjustable bias voltage is applied on the roller so that the toner image is passed and cleaning is conducted.

The above object can be attained by an image forming apparatus comprising: a first image carrier means; a plurality of sets of a charging means for charging the first image carrier means, an image writing means for writing an image onto the charged first image carrier means so as to form a latent image, and a developing means for developing the latent image formed on the first image carrier means; a toner image forming means for forming superimposed toner images on the first image carrier means by repeating charging by the charging means, image writing by the image writing means, and developing by the developing means, during a single rotation of the first image carrier means; a second image carrier means onto which the toner image formed by the first image carrier means is transferred, and on the surface of which the toner image is carried; a first transfer means for transferring the toner image formed on the first image carrier means onto the second image carrier means and the surface of a transfer material; a second transfer means for transferring the toner image carried on the second image carrier means onto the reverse surface of the transfer material; a fixing means for fixing the toner image transferred onto the transfer material; and a cleaning means which can come into contact with and be removed from the second image carrier means, the image forming apparatus characterized in that a distance, from the transfer position of the first transfer means to the contact position of the cleaning means, located upstream in the direction of movement of the second image carrier means, is set to be longer than the distance, from the transfer position of the first transfer means to the image writing position which is nearest in the upstream side of the direction of movement of the first image carrier means, and is set to be shorter than the distance, from the transfer position of the first transfer means to the image writing position of the image writing means which is farthest in the upstream side of the direction of movement of the first image carrier means; writing of the image corresponding to the reverse surface of the transfer material starts while the cleaning means is in contact with the second image carrier means, and after the writing of the image corresponding to the reverse surface of the transfer material has been entirely completed, contact of the cleaning means is released; after the contact of the cleaning means has been released, the writing of the image corresponding to the obverse surface starts, and after the writing of the image corresponding to the obverse surface of the transfer material has been entirely completed, the cleaning means comes into contact with the second image carrier means.

The above object can be attained by an image forming apparatus comprising: a toner image forming means for forming a toner image on the first image carrier means by a first image carrier means, a charging means for charging the first image carrier means, an image writing means for writing an image onto the charged first image carrier means so as to form a latent image, and a developing means for developing the latent image formed on the first image carrier means; a second image carrier means onto which the toner image formed by the first image carrier means is transferred, and on the surface of which the toner image is carried; a first transfer means for transferring the toner image formed on the first image carrier means onto the second image carrier means and the obverse surface of a transfer material; a second transfer means for transferring the toner image carried on the second image carrier means onto the reverse surface of the transfer material; a fixing means for fixing the toner image transferred onto the transfer material; and a cleaning means which can come into contact with and be removed from the second image carrier means, the image forming apparatus characterized in that the distance, from the transfer position of the first transfer means to the contact position of the cleaning means, located at the upstream side in the direction of movement of the second image carrier means, is set to be longer than the distance, from the transfer position of the first transfer means to the image writing position located at the upstream side in the direction of movement of the first image carrier means; writing of the image corresponding to the reverse surface of the transfer material starts while the cleaning means is in contact with the second image carrier means, and after the writing of the image corresponding to the reverse surface of the transfer material has been completed, contact of the cleaning means is released; after the contact of the cleaning means has been released, the writing of the image corresponding to the obverse surface starts, and after the writing of the image corresponding to the obverse surface of the transfer material has been completed, the cleaning means is brought into contact with the second image carrier means.

In the above image forming apparatus, the following image forming apparatus is a preferable embodiment which is characterized in that writing of the image corresponding to the reverse surface of the transfer material starts, after an arbitrary point has been moved by a specific distance, obtained by subtracting the distance from the transfer position of the first transfer means to the image writing position of the image writing means located upstream in the direction of movement of the first image carrier means, from the distance from the transfer position of the first transfer means to the contact position of the cleaning means located upstream in the direction of movement of the second image carrier means, while the cleaning means is in contact with the second image carrier means.

The above object can be attained by an image forming apparatus comprising: a toner image forming means for forming a toner image on the first image carrier means by a first image carrier means, a charging means for charging the first image carrier means, an image writing means for writing an image onto the charged first image carrier means so as to form a latent image, and a developing means for developing the latent image formed on the first image carrier means; a second image carrier means onto which the toner image formed by the first image carrier means is transferred, and on the surface of which the toner image is carried; a first transfer means for transferring the toner image formed on the first image carrier means onto the second image carrier means and the obverse surface of a transfer material; a second transfer means for transferring the toner image carried on the second image carrier means onto the reverse surface of the transfer material; a fixing means for fixing the toner image transferred onto the transfer material; and a cleaning means which can be brought into contact with and withdrawn from the second image carrier means, the image forming apparatus characterized in that, when the second image carrier means is stopped, the image carrier means is rotated by, at least, more than one rotation, while the cleaning means is in contact with the second image carrier means.

The above object can be attained by an image forming apparatus comprising: a first image carrier means to carry a toner image, formed on its surface by a toner image forming means; a second image carrier means onto which the toner image, carried on the first image carrier means, is transferred, and on the surface of which the transferred toner image is carried; a first transfer means for transferring the toner image, carried on the first image carrier means, onto the obverse surface of a transfer material; a second transfer means for transferring the toner image, carried on the second image carrier means, onto the reverse surface of the transfer material; and a fixing means for transferring the toner images transferred onto both surfaces of the transfer material; the image forming apparatus characterized in that the transfer material charging means for charging the transfer material, which moves to the second image carrier means, so that the transfer material is attracted onto the second image carrier means, can move to the charging position to charge the transfer material, while the charging means is in contact with the transfer material, and to the non-charging position separated from the transfer material.

Furthermore, the above object can be attained by an image forming apparatus comprising: a first image carrier means to carry a toner image, formed on its surface by a toner image forming means; a second image carrier means onto which the toner image, carried on the first image carrier means, is transferred, and on the surface of which the transferred toner image is carried; a first transfer means for transferring the toner image, carried on the first image carrier means, onto the obverse surface of a transfer material; a second transfer means for transferring the toner image, carried on the second image carrier means, onto the reverse surface of the transfer material; and a fixing means for transferring the toner images transferred onto the double surfaces of the transfer material; the image forming apparatus characterized in that the transfer material charging means for charging the transfer material which moves to the second image carrier means, and for attracting the transfer material to the second image carrier means, is provided close to or in contact with second image carrier means; a bias voltage with the same polarity as that of the toner on the second image carrier means is applied onto the transfer material charging means when the transfer material passes, and a bias voltage with the same polarity as that of the toner on the second image carrier means is also applied onto the transfer material charging means, when the transfer material is not passed.

DETAILED DESCRIPTION OF THE PREFERRED EMBODIMENT

An example of the present invention will be described below. In this connection, descriptions in the present section are not intended to limit the technological scope of claims, or meanings of terms. Further, conclusive explanations in examples of the present invention below only show a best mode of the example, and does not limit meanings of terms or the scope of technology of the present invention. Still further, in the explanations of examples below, an image which is transferred onto one surface, facing an image carrier, of a transfer material in the transfer area, is called the obverse surface image; and an image which is transferred onto the other surface is called the reverse surface image.

EXAMPLE 1

Figure 1:
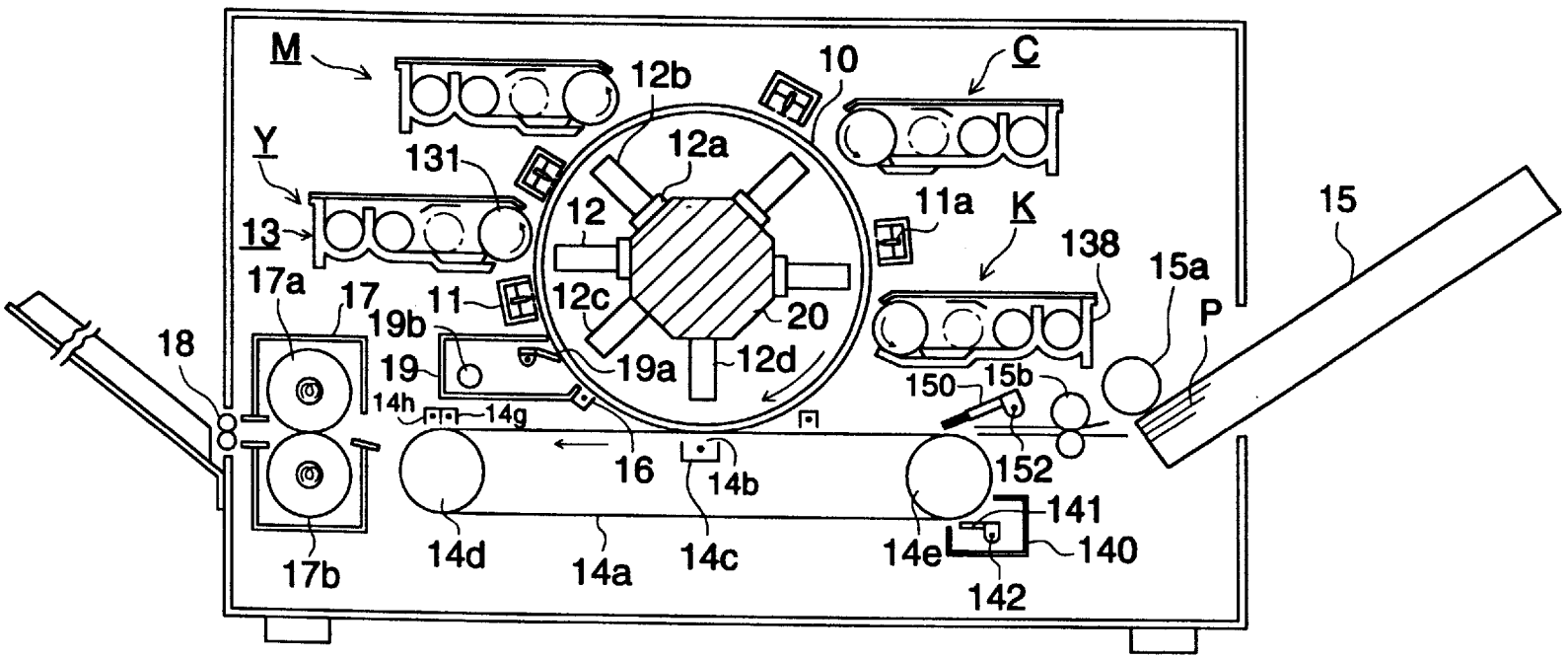
FIG. 1 is a sectional view of the structure of a color image forming apparatus showing Example 1.
Figure 2:
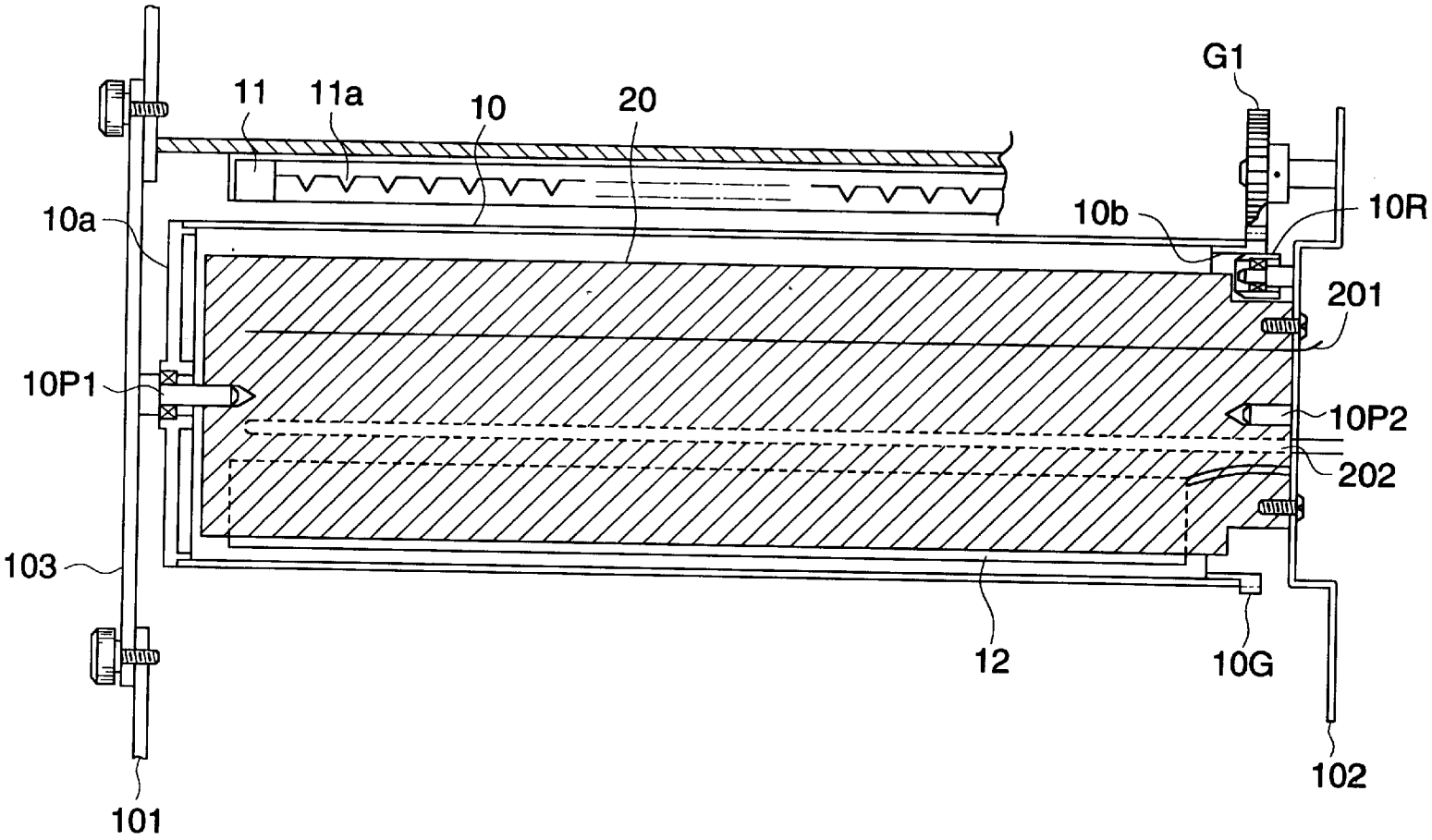
FIG. 2 is a sectional side view of an image carrier of FIG. 1.
Figure 3:
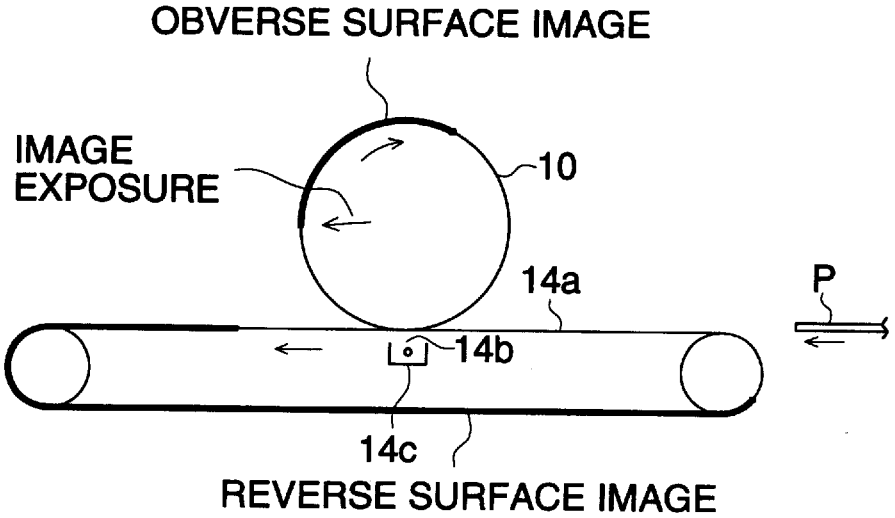
FIG. 3 is a view showing toner image forming conditions on both surfaces of a transfer sheet.

Referring to FIGS. 1 through 3, an image forming process and each mechanism of the first example of an image forming apparatus of the present invention will be described below. FIG. 1 is a sectional view of the structure of a color image forming apparatus showing the first example of the present invention. FIG. 2 is a sectional side view of the image carrier in FIG. 1. FIG. 3 is a view showing a double-sided toner image forming conditions.

A photoreceptor drum 10, which is an image carrier, is provided inside with a cylindrical base body formed of a transparent member of, for example, glass or transparent acrylic resin, and is also provided with a transparent conductive layer, and a photoreceptor layer such as an a-Si (amorphous silicon) layer, an organic photoreceptor layer (OPC), etc., on the outer periphery of the cited base body.

The photoreceptor drum 10 is mounted between a front flange 10*a* and a rear flange 10*b*; the front flange 10*a* is pivoted by a guide pin 10P1 provided on a cover 103, attached to a front side plate 101 of the apparatus main body; the rear flange 10*b* is engaged on the outer surface of a plurality of guide rollers 10R, provided on a rear side plate 102 of the apparatus main body; and thereby the photoreceptor drum 10 is held. A gear 10G, provided on the outer periphery of the rear flange 10*b*, is engaged with a driving gear G1, and by its driving power, the photoreceptor drum 10 is rotated clockwise as shown in FIG. 1, while the transparent conductive layer is electrically grounded.

In the present example, the transparent base body may have only an amount of exposure, which can form an appropriate contrast on a light conductive layer of the photoreceptor drum. Accordingly, it is not necessary that the light transparency factor of a transparent base body of the photoreceptor drum be 100%, but may have a characteristic in which some amount of light is absorbed at the time of transmission of the exposure beam. As light transmissive base body materials, acrylic resins, specifically, polymers incorporating a methyl methacrylate monomer, are excellent for the transparency, strength, accuracy, surface property, etc., and are preferably used. Further, any type of light transmissive resins such as acryl, fluorine, polyester, polycarbonate, polyethylene terephthalate, etc., which are used for general optical members, may be used. The material may even be colored if it still has light permeability with respect to the exposure light beams. As a transmissive light conductive layer, a vacuum deposition method, an activated reaction deposition method, any type of spattering method, any type of CVD method, are used as film forming methods, and indium, tin oxide (ITO), lead oxide, indium oxide, copper iodide, or a metallic film, in which light permeability is still maintained, and which is formed of Au, Ag, Ni, Al, etc., can be used. As film forming methods, any dip coating method, any spray coating method, etc., can be used, and conductive resins, made of above metallic fine particles and binder resins, are used. As light conductive layers, an amorphous silicon (a-Si) alloy photoreceptor layer, an amorphous selenium alloy photoreceptor layer, or any type of organic photoreceptor layer (OPC), can be used.

A scorotron charger 11, which is a charging means, is used for image forming processes of each color of yellow (Y), magenta (M), cyan (C) and black (K). The charger is mounted in the direction perpendicular to the moving direction of the photoreceptor drum 10 which is an image carrier, and opposed to the photoreceptor drum 10; and it charges (negative charging in the present example) the organic photoreceptor layer on the photoreceptor drum 10 by a corona discharge with the same polarity as the toner, by using a control grid having a predetermined potential voltage and, for example, a saw tooth type electrode as a discharge electrode 11*a*, so that a uniform potential voltage is applied onto the photoreceptor drum 10. As the corona discharge electrode 11*a*, a wire electrode can also be used instead of the above cited electrode.

An exposure unit 12, as an image exposure means for each color, is arranged in such a manner that the exposure position on the photoreceptor drum 10 is set upstream in the rotational direction of the photoreceptor drum with respect to a developing sleeve 131, between the discharge electrode 11*a* of the scorotron charger 11 and the developing position of a developing device 13.

An exposure unit 12 is structured as a unit for the exposure, onto which a linear exposure element 12*a*, in which a plurality of LEDs (light emitting diodes) as a light emitting element for image exposure lights are arrayed, and a Selfoc lens 12*b* as a life-sized image forming element, are attached onto a holder (not shown), wherein the LEDs and the Selfoc lens are arranged in the primary scanning direction parallel to the axis of the photoreceptor drum 10. The exposure unit 12 for each color, a uniform exposure device 12*c* and a transfer-simultaneous exposure device 12*d* are attached onto a cylindrical holding member 20 which is fixed by being guided by a guide pin 10P2, provided on a rear side plate 102 of the apparatus main body, and another guide pin 10P1, provided on a cover 103 attached on a front side plate 101, and is accommodated inside the base body of the photoreceptor drum 10. Image data for each color, which has been read by an image reading apparatus, provided separately from the apparatus maim body, and stored in a memory, is sequentially read from the memory and respectively inputted into the exposure unit 12 for each color as electrical signals.

As the exposure elements, a linear exposure element in which a plurality of light emitting elements such as Fls (fluorescent material emission elements), Els (electroluminescence elements), PLs (plasma discharge elements), LEDs (light emitting diodes), etc., are aligned array-like, is used other than the above-described elements. The wavelength of light emission of the light emitting elements used in the present invention is preferable in the range of 680–900 nm, in which the permeability of Y, M, C toners is normally high. However, because image exposure is carried out from the rear surface of the photoreceptor drum, the shorter wavelength, which has insufficient transparency for color toner, may be used.

Regarding color sequence of the image formation, the developing devices, provided around the rotating photoreceptor drum according to the color sequence, are arranged in the present example as follows: with respect to the rotational direction of the photoreceptor drum 10 shown by an arrow in FIG. 1, the Y and M developing devices 13 are arranged on the left side of the photoreceptor drum 10; the C and K developing devices are arranged on the right side of the photoreceptor drum 10; the Y and M scorotron chargers 11 are arranged below developing casings 138 of the Y and M developing devices; and the C and K scorotron chargers 11 are arranged above developing casings 138 of the C and K developing devices.

The developing devices 13, which are developing means for each color, respectively accommodate one-component or two-component developers for yellow (Y), magenta (M), cyan (C) and black (K), and are provided with developing sleeves 131, formed of, for example, cylindrical non-magnetic stainless steel or aluminum material of 0.5–1 mm thickness, and of 15–25 mm outer diameter, developing sleeves being respectively rotated in the same direction as the photoreceptor drum 10 at the developing position, while keeping a predetermined gap with respect to the peripheral surface of the photoreceptor drum 10.

The developing device 13 is maintained to be in non-contact with the photoreceptor drum 10 by a roller, not shown, while keeping a predetermined gap, for example, of 100–1000 mm. At a developing operation by the developing device 13 for each color, a developing bias voltage of a DC voltage, or further an AC voltage AC in addition to the DC voltage, is applied on the developing sleeve 131; jumping development is carried out by the one-component or two-component developer accommodated in the developing device; a DC bias voltage having the same polarity as the toner (negative polarity in the present example), is applied on the negatively charged photoreceptor drum 10 in which a transparent conductive layer is grounded; and non-contact reversal development is carried out to adhere toner onto the exposure section. At this time, the accuracy of development space of smaller than approximately 20 mm is necessary to prevent a non-uniform image.

The developing device 13 for each color reversal develops an electrostatic latent image on the photoreceptor drum 10, which is formed by charge of the scorotron charger 11 and image exposure by the exposure unit 12, in a no-contact condition, by the non-contact development method by application of a development bias voltage, by using toner having the same polarity as the charged polarity (in the present example, the photoreceptor drum is negatively charged, and the polarity of toner is also negative).

Images read by image pick-up elements of an image reading apparatus, separated from the present apparatus, or images edited by a computer, as a document image, are temporarily stored in a memory as image data for each color of Y, M, C and K.

A photoreceptor driving motor, not shown, is started at the start of image recording; a gear 10G provided on a rear flange 10*b* of the photoreceptor drum 10 is rotated through a driving gear G1; the photoreceptor drum 10 is rotated clockwise as shown by the arrow in FIG. 1; and simultaneously, application of potential voltage is started on the photoreceptor drum 10 by the charging operation of the Y scorotron charger 11, which is located below the developing casing 138 of the yellow (Y) developing device 13, located at the left of the photoreceptor drum 10.

After application of the potential voltage on the photoreceptor drum 10, exposure by electrical signals corresponding to the first color signal, that is, Y image data, is started by the Y exposure unit 12, and an electrostatic latent image is formed on the photoreceptor layer of the photoreceptor drum 10 corresponding to the Y image of the document image by rotational scanning of the drum.

The latent image is reversal-developed by the Y developing device 13 under non-contact condition of developer on the developing sleeve, and a yellow (Y) toner image is formed on the photoreceptor drum 10 corresponding to its rotation.

Next, potential voltage is applied on the yellow (Y) toner image formed on the photoreceptor drum 10, by the charging operation of the scorotron charger 11 for magenta (M) which is located on the left of the photoreceptor drum 10, above the developing device 13 for yellow(Y), and below the developing casing 138 of the developing device 13 for magenta (M); exposure is carried out by electrical signals corresponding to the second color signal of the exposure unit 12, that is, image data of M; and then, the magenta (M) toner image is formed by successively being superimposed on the yellow (Y) toner image by the non-contact reversal development by the developing device 13 for M.

Further, in the same process, the cyan (C) toner image corresponding to the third color signal is formed by the scorotron charger 11 for cyan (C), located on the right of the photoreceptor drum 10 and above the developing casing 138 of the developing device 13 for cyan (C), the exposure unit 12 for C, and the developing device 13 for C; and the black (K) toner image corresponding to the fourth color signal is successively formed by being superimposed on other toner images by the scorotron charger 11 for black (K), located on the right of the photoreceptor drum 10, below the developing device for C and above the developing casing 138 of the developing device 13 for black (K), the exposure unit 12 and developing device 13; and a full color toner image is formed on the peripheral surface of the photoreceptor drum 10 during a single rotation (the toner image forming means).

The exposure onto the organic photoreceptor layer of the photoreceptor drum 10 by the exposure units for Y, M, C and K is carried out from the inside of the drum through the transparent base body. Accordingly, the exposure for the image corresponding to the second, third and forth color signals is carried out without influence of the previously formed toner images, so that the electrostatic latent image similar to the image corresponding to the first color signal ban be formed. In this connection, temperature and the temperature rise inside the photoreceptor drum 10 caused by heat generation of the exposure optical systems 12, can be stabilized or prevented, and suppressed to an acceptable degree by countermeasures in which a good heat conductivity material is used for the holding member 20; a heater 201 is used when the interior temperature is low; heat is radiated outside through a heat pipe 202 when the interior temperature is high, or by similar means.

By the image forming processes, a superimposed color toner image, which is a reverse surface image, is formed on the photoreceptor drum 10 (the first image carrier mean), which is the image carrier. The superimposed color toner image as the reverse surface image on the photoreceptor drum 10 is collectively transferred onto a toner image receiving body 14*a* (the second image carrier means), which is stretched between the driving roller 14*d* and the driven roller 14*e*, and is provided close to the photoreceptor drum 10 or in contact with the drum, by the transfer device 14*c*, onto which a voltage having reverse polarity of the toner (positive polarity in the present example) is applied, in the transfer area 14*b*. At this time, in order to conduct an excellent transfer, the uniform exposure is carried out by the transfer simultaneous exposure device 12*d* using, for example, light emitting diodes.

Toner remaining on the peripheral surface of the photoreceptor drum 10, after transfer, is discharged by an image carrier AC discharger 16. Then, the toner is moved to a cleaning device 19, and is cleaned by a cleaning blade 19*a* made of a rubber material, which is in contact with the photoreceptor drum 10. Further, in order to eliminate the hysteresis of the photoreceptor due to the previous printing, the peripheral surface of the photoreceptor is discharged by a uniform exposure device 12*c* using, for example, a light emitting diode, before charging, so that electrical charges from the previous printing are eliminated, and following that, the color image formation for the obverse image is conducted.

The obverse image of the superimposed color toner image is formed on the photoreceptor drum 10 in the same manner as the above cited color image forming process, in synchronization with the reverse image formed on the toner receiving body 14*a* in the transfer area 14*b*. It is necessary to change image data so that the obverse image formed at the time, forms a mirror image with respect to the reverse image on the image carrier.

A recording sheet P, which is a transfer material, is sent from a sheet feed cassette 15, which is a transfer material accommodation means, by a feed roller 15*a*, and conveyed to a timing roller 15*b*.

The recording sheet P is sent to the transfer area 14*b* by the timing roller 15*b* in synchronization with the color toner image as the obverse image carried on the photoreceptor drum 10, and the color toner image as the reverse image carried on the toner image receiving body 14*a*. In this case, the recording sheet P, which is a transfer material, is paper-charged to the same polarity as the toner by a paper charger 150, is attracted to the toner image receiving body 14*a*, and is sent to the transfer area 14*b*, wherein the paper charger 150 having a brush-like leading edge, which serves as a transfer material charging means, can contact with and be removed from the toner image receiving body 14*a* by rotating around a support shaft 152, and is contact with the recording sheet P. By paper-charging the recording sheet P to the same polarity as the toner, it prevents the recording sheet P to be attracted to each other by the toner image on the toner image receiving body, or the toner image on the image carrier, so that the toner image is not disturbed. Simultaneously with passage of the recording sheet P, the paper charger 150 is separated from the toner image receiving body 14*a*, and the contact is released. Incidentally, as a transfer material charging means, a conductive roller, which can contact with and removed from the toner image receiving body, a corona charger, separately provided from the toner image receiving body, or a similar device, may be used.

The obverse surface image on the peripheral surface of the photoreceptor drum 10 is collectively transferred onto the upper surface side (obverse surface side) of the recording sheet P by the transfer device 14*c*, onto which voltage with reversed polarity as the toner (in the present example, positive polarity) is applied, (the first transfer means). In this case, the reverse image on the peripheral surface of the toner image receiving body 14*a* is not transferred onto the recording sheet P, but exists on the toner image receiving body 14*a*. Next, the reverse image on the peripheral surface on the toner image receiving body 14*a* is collectively transferred onto the lower surface side (reverse surface side) of the recording sheet P, by a reverse surface transfer device 14*g*, onto which the voltage with reversed polarity as the toner (in the present example, positive polarity) has been applied, (the second transfer means). At the time of transferring by the transfer device 14*c*, uniform exposure by the transfer simultaneous exposure device 12*d* using, for example, a light emitting diode, which is provided inside the photoreceptor drum 10 opposed to the transfer device 14*c*, is carried out so that excellent transferring can be carried out. A bias roller may be used as the first transfer means, other than above devices.

Because a toner image for each color is superimposed on previous ones, it is preferable for the collective transfer, that the upper layer and the lower layer of the toner layer are charged by the same charging amount and with the same polarity. For this reason, the double-surface image formation, in which the polarity of the color toner image formed on the toner image receiving body 14*a* is reversed by corona charging, or in which the polarity of the color toner image formed on the image carrier is reversed by corona charging, is not preferable because the lower layer toner is not sufficiently charged with the same polarity, resulting in inadequate transfer.

It is preferable for an increase of the transfer property of the reversal image formation that the reversal development is repeated on the image carrier; the color toner image with the same polarity formed by superimposition, is collectively transferred onto the toner image receiving body 14*a* while the polarity is not changed; and next, it is collectively transferred onto the recording sheet P while the polarity is not changed. Also for the obverse image formation, it is preferable that the reversal development is repeated on the image carrier, and the color toner image with the same polarity formed by superimposition, is collectively transferred onto the recording sheet P while the polarity is not changed, for an increase of the transfer property of the obverse image formation.

From the above description, in the full color image formation, the double-surface image formation method is preferably adopted in which the color toner image is formed on the obverse surface of the transfer material by operating the first transfer means, and next, the color toner image is formed on the reverse surface of the transfer material by operating the second transfer means, by using the above-described image formation method for both the obverse and reverse surfaces.

Toner image receiving body 14*a* is a 0.5–2.0 mm thick endless rubber belt, and is structured of 2 layers of a semiconductive base body, having a resistance value of $10^8$–$10^{12}$ Ω·cm, which is formed of silicon rubber or urethane rubber, and a 5–50 mm thick fluorine coating layer as a toner filming prevention layer, formed on the rubber base body. This layer is also preferably semi-conductive. Instead of the rubber belt base body, a 0.1–0.5 mm thick semi-conductive polyester, polystyrene, polyethylene, polyethylene terephthalate material, etc., may also be used.

The recording sheet P, on the double-surfaces of which the color toner image has been formed, is discharged by a sheet separation AC discharger 14*h* for transfer material separation, separated from the toner image receiving body 14*a*, and is conveyed to a fixing device 17 as a fixing means, composed of 2 rollers respectively housing a heater. Adhered toner on the obverse and reverse sides of the recording sheet P is fixed by application of a heat and pressure between a fixing roller 17*a* and a pressure roller 17*b*; and the recording sheet P on both sides of which images have been recorded, is sent by sheet delivery rollers 18 and delivered onto a tray provided outside the apparatus.

Toner remaining on the peripheral surface of the toner image receiving body 14*a* after transferring, is removed by a toner image receiving body cleaning blade 141, which is, as described later, provided in a toner image receiving body cleaning device 140, which serves as a cleaning means, and can contact with and be removed from the toner image receiving body 14*a*, by rotating around the support shaft 142. Toner remaining on the peripheral surface of the photoreceptor drum 10 after transferring is discharged by an image carrier AC discharge 16; is then moved into the cleaning device 19; scraped off by a cleaning blade 19*a*, made of a rubber material, being in contact with the photoreceptor drum 10, into the cleaning device 19; and is collected into a waste toner container, not shown, by a screw 19*b*. The photoreceptor drum 10, from the surface of which the remaining toner has been removed by the cleaning device 19, is uniformly charged by the Y scorotron charger 11, and then enters into the next image formation cycle.

By using the above method, because superimposed color toner images are collectively transferred, color doubling of the color image on the toner image receiving body, toner scattering, or a frictional damage hardly occurs, so that excellent double-sided color image formation can be conducted with smallest image deterioration.

In the above image forming apparatus, of course, single side copy can be carried out by the first or second image carrier means.

Figure 4:
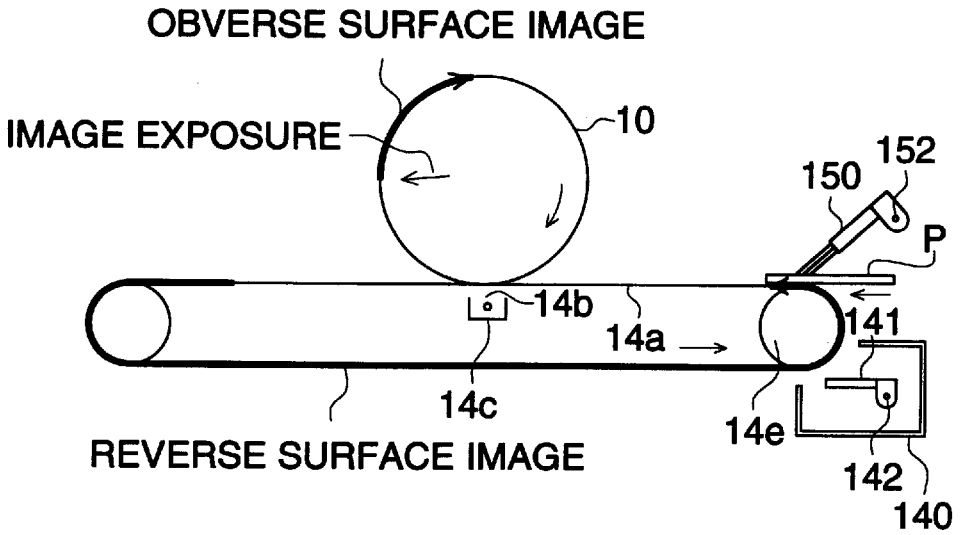
FIGS. 4(A) and 4(B) are views showing contact timing of a transfer material charging means and a cleaning means with a toner image receiving body.
Figure 4:
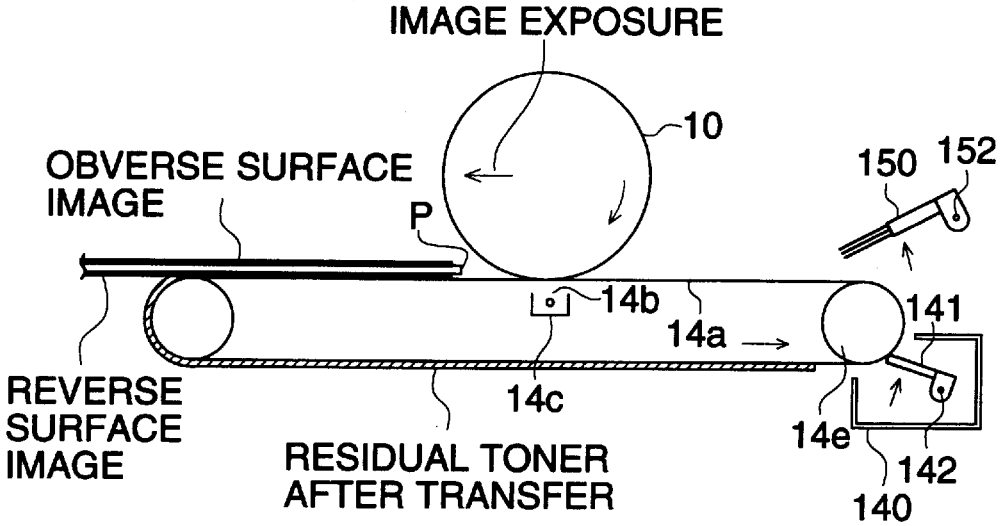
Figure 5:
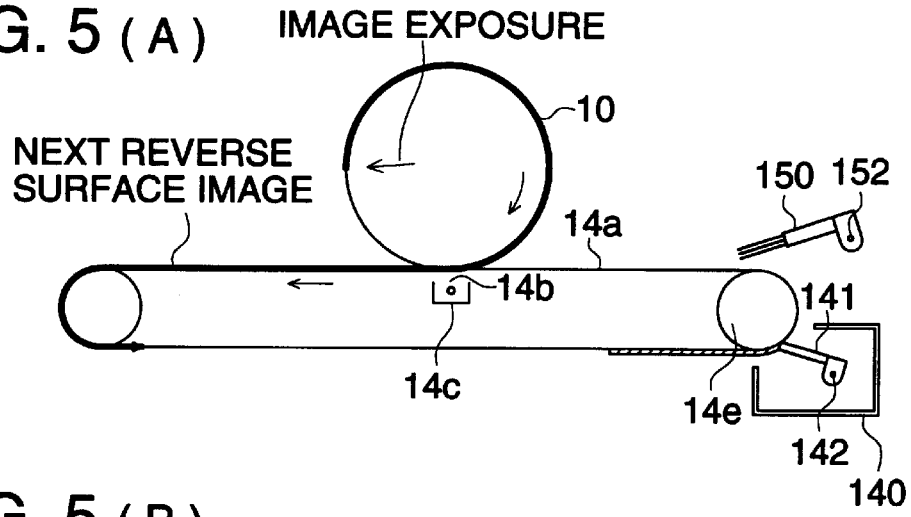
FIGS. 5(A) to 5(C) are views showing release timing of contact of the cleaning means from the toner image receiving body.
Figure 5:
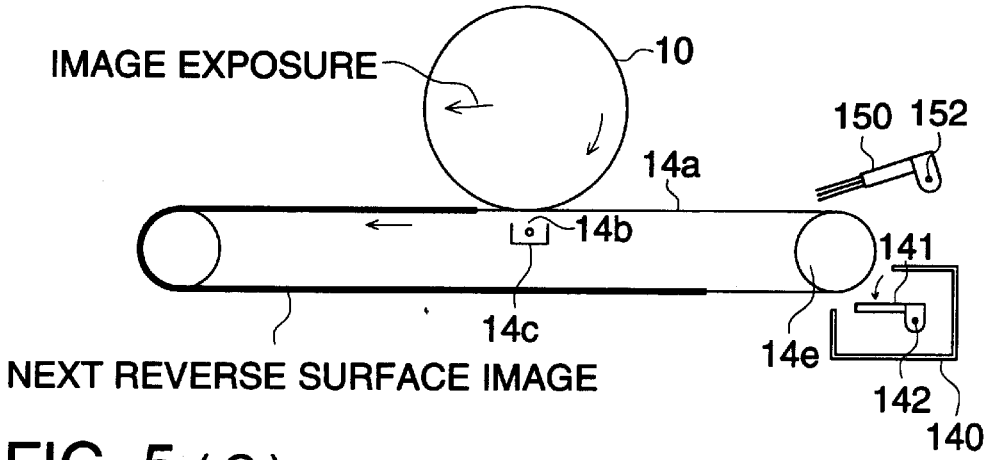
Figure 5:
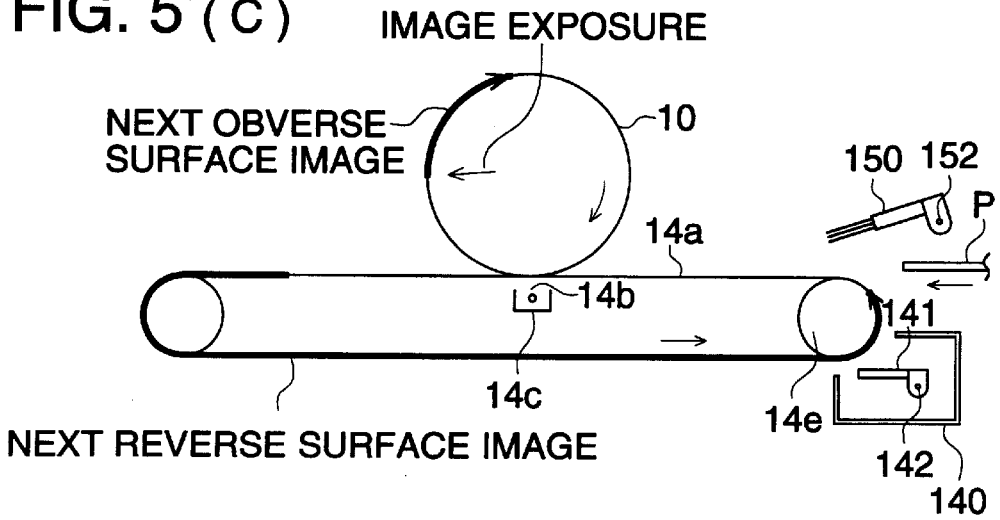

Next, referring to FIGS. 4 and 5, contact and contact-release timing of the transfer material charging means and the cleaning means with respect to the toner image receiving body will be described. FIG. 4 is a view showing the contact timing of the transfer material charging means and the cleaning means with the toner image receiving body. FIG. 4(A) is a view showing the contact timing of the transfer material charging means, and FIG. 4(B) is a view showing the contact timing of the cleaning means. FIG. 5 is a view showing the contact-release timing of the cleaning means from the toner image receiving body. FIG. 5(A) is a view showing a toner image formation condition at the time of contact of the cleaning means with the toner image receiving body. FIG. 5(B) is a view showing timing of contact-release of the cleaning means, and FIG. 5(C) is a view showing a toner image formation condition at the ti me of contact-release of the cleaning means.

In the double-sided image forming process described above, the toner image receiving body cleaning device 140 is provided on the entry side of the recording sheet P, which is the transfer material, being opposed to a driven roller 14*e* of the toner image receiving body 14*a*, as shown in FIG. 4(A). While the toner image receiving body cleaning blade 141, which is provided in the toner image receiving body cleaning device 140, and is rotatable around the support shaft 142, is separated from the toner image receiving body 14*a*, just before the recording sheet P, which is just going to be conveyed onto the toner image receiving body 14*a*, is superimposed on a color toner image, which is a reverse surface image, carried on the toner image receiving body 14*a*, the paper charger 150, which serves as a transfer material charging means, is rotated around the support shaft 152 and is in contact with the leading edge of the recording sheet P. Herein, the recording sheet P is synchronized with a color toner image, which is an obverse surface image, carried on the photoreceptor drum 10, and with also a color toner image, which is a reverse surface image, carried on the toner image receiving body 14*a*, and is sent to the transfer area 14*b* on the transfer device 14*c*, which serves as the first transfer means, by a timing roller, not shown. Incidentally, simultaneously with the contact, the paper charger 150 is under the condition of bias voltage application.

The paper charger 150 is removed from the toner image receiving body 14*a* just before or simultaneously with passage of trailing edge of the recording sheet P, and is separated from the recording sheet P. Bias voltage is applied onto the paper charger 150 only during conveyance of the recording sheet p. Simultaneously with separation from the recording sheet P, the bias voltage application onto the paper charger 150 is stopped.

As shown in FIG. 4(B), after the toner image on the photoreceptor drum 10 has been transferred onto the recording sheet P by the transfer device 14*c*, before the leading edge of residual toner after transfer on the toner image receiving body 14*a* comes to the cleaning position by the toner image receiving body cleaning blade 141, the toner image receiving body cleaning blade 141 of the toner image receiving body cleaning device 140 is rotated around the supporting shaft 142, and its leading edge is in contact with the toner image receiving body 14*a*. At this time, contact of the toner image receiving body cleaning blade 141 of the toner image receiving body cleaning device 140, which serves as a cleaning means, with the toner image receiving body 14*a* is preferably carried out after the obverse surface image on the photoreceptor drum 10 has been transferred up to the trailing edge of the image by the transfer device 14*c*, and the trailing edge has passed the transfer area 14*b*, which is a transfer position on the transfer device 14*c*, as shown in FIG. 4(B), so that un-uniform image is not produced at the time of the transfer operation of the transfer device 14*c*, which serves as the first transfer means, by the shock at the time of contact of the toner image receiving body cleaning blade 141 of the toner image receiving body cleaning device 140, which is the cleaning means, provided opposed to the toner image receiving body 14*a*, which serves as the second image carrier means.

It is preferable that a distance to the cleaning position of the toner image receiving body cleaning blade 141, provided in the toner image receiving body cleaning device 140, which serves as the cleaning means, located at the downstream in the rotational direction of the toner image receiving body 14*a*, which is the second image carrier means, viewed from the transfer area 14*b*, which is the transfer position at which the transfer device 14*c*, which is the first transfer means, is provided, is not smaller than the maximum image size (a possible maximum length of a recording sheet in the subs canning direction), for example, the size in the longitudinal direction of a size A-3, of a toner image, which can be formed on the toner image receiving body 14*a*, which is the second image carrier means.

Image exposure for the succeedingly formed reverse surface image of the double-sided images, may be started by the image exposure means (in the present example, the first image exposure means for Y), after residual toner on the toner image receiving body 14*a* after transfer has been cleaned, and contact of the toner image receiving body cleaning blade 141 has been released. However, because cleaning time is of no use, image exposure for the succeedingly formed reverse surface image of the double-sided images is started onto the photoreceptor drum 10, just after the toner image receiving body cleaning blade 141 has been in contact with the toner image receiving body 14*a*. it is preferable that contact or contact release of the cleaning means is not carried out during image exposure. The shock caused by the cleaning means at this time results in uneven image formation of the photoreceptor drum. Further, in the same way, it is preferable that contact or contact release of the cleaning means is not carried out during development, in order to prevent uneven development.

Just after the toner image receiving body cleaning blade 141, provided in the toner image receiving body cleaning device 140, has been in contact with the toner image receiving body 14*a*, image exposure for the succeedingly formed reverse surface image of the double-sided images is started onto the photoreceptor drum 10. As shown in FIG. 5(A), while the toner image receiving body 14*a* is cleaned by the toner image receiving body cleaning device 140, the succeedingly formed reverse surface image of the double-sided images is formed on the photoreceptor drum 10, and the reverse surface image carried on the photoreceptor drum 10 is transferred onto the toner image receiving body 14*a* by the transfer device 14*c*, which serves as the first transfer means.

As shown in FIG. 5(B), before the leading edge of the toner image carried on the toner image receiving body 14*a* comes to a position opposed to the toner image receiving body cleaning device 140, after all the toner image for the reverse surface image has passed through the transfer area 14*b* of the transfer device 14*c* as the first transfer means, the contact of the toner image receiving body cleaning blade 141 of the toner image receiving body cleaning device 140 is released.

Just after the contact release of the toner image receiving body cleaning blade 141, image exposure for the succeedingly formed obverse surface image of the double-sided images is started by the image exposure means (in the present example, the first image exposure means of Y). Accordingly, it is preferable that a distance to the transfer area 14*b*, which is a transfer position of the transfer device 14*c* as the first transfer means, in the downstream of the rotational direction of the photoreceptor drum 10, viewed from the image exposure position of the image exposure means onto the photoreceptor drum 10, which serves as the first image carrier means, is not larger than the distance to the transfer position of the transfer device 14*c* in the downstream of the rotational direction of the toner image receiving body 14*a*, viewed from the leading edge of the image surface of the toner image, carried on the toner image receiving body 14*a*, which serves as the second image carrier means. That is, it is preferable that the distance to the transfer area 14*b*, which is a transfer position of the transfer device 14*c* in the downstream of the rotational direction of the photoreceptor drum 10, viewed from the image exposure position onto the photoreceptor drum 10 by the image exposure means (in the present example, the first image exposure means of Y), is not larger than the distance to the transfer position of the transfer device 14*c*, which serves as the first transfer means, in the downstream of the rotational direction of the toner image receiving body 14*a*, which serves as the second image carrier means, viewed from the cleaning position of the toner image receiving body cleaning blade 141, provided in the toner image receiving body cleaning device 140, which serves as the cleaning means, provided on the toner image receiving body 14*a*, which serves as the second image carrier means.

As shown in FIG. 5(C), the obverse surface image of the succeedingly formed double-sided images is formed on the photoreceptor drum 10, in timed relationship with the reverse surface image, carried on the toner image receiving body 14*a*, in the transfer area 14*c*, under the contact-release condition of the toner image receiving body cleaning blade 141, and as described in FIG. 4(A), the double-sided images are formed again, and processes, as described in FIGS. 4(A) through 5(C), are repeated.

Figure 6:
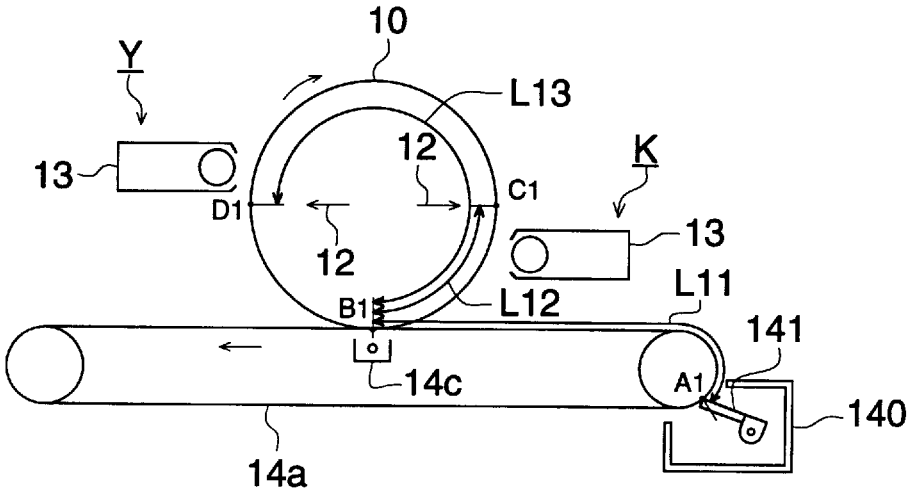
FIG. 6 is a view showing setting conditions of the contact position of the cleaning means and an image writing position of an image writing means in Example 1.
Figure 7:
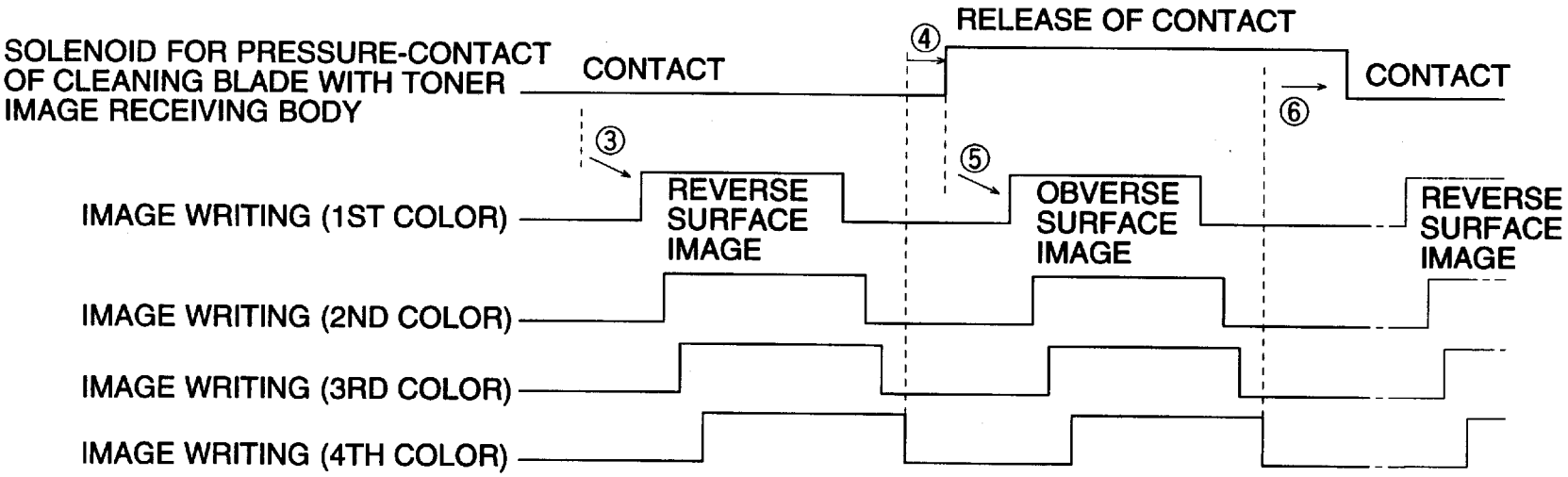
FIG. 7 is a time chart showing timing of contact and release of contact of the cleaning means, and timing of image writing by the image writing means in Example 1.

Next, referring to FIGS. 6 and 7, setting conditions of the contact position of the blade member 141 of the toner image receiving body cleaning device 140, which serves as the cleaning means, with the toner image receiving body 14*a*, and the image writing position of an exposure unit 12 which is an image writing means; contact and contact-release timing of the blade member 141 and image writing timing by the exposure unit 12; and conditions necessary when the toner image receiving body 14*a* is stopped, which are major objects of the present invention, will be described.

(1) Distance L11 from the transfer position B1 of the transfer device 14*c* to the contact position A1 of the blade member 141 on the upstream side in the movement direction of the toner image receiving body 14*a*, is set to be longer than the distance L12 from the transfer position B1 of the transfer device 14*c* to the image writing position C1 by K exposure unit 12, located nearest to the transfer position B1, on the upstream side in the movement direction of the photoreceptor drum 10, (L11>L12).

(2) Distance L11 from the transfer position B1 of the transfer device 14*c* to the contact position A1 of the blade member 141 on the upstream side in the movement direction of the toner image receiving body 14*a*, is set to be smaller than the distance L13 from the transfer position B1 of the transfer device 14*c* to the image writing position D1 by Y exposure unit 12, located furthest to the transfer position B1, on the upstream side in the movement direction of the photoreceptor drum 10, (L11<L13).

(3) While the blade member 141 is in contact with the toner image receiving body 14*a*, image writing of the first color Y, corresponding to the reverse surface image of the recording sheet P, by Y exposure unit 12, located furthest to the transfer position B1 on the upstream side in the movement direction of the photoreceptor drum 10, viewed from the transfer position B1 of the transfer device 14*c*, is started, and image writing of the second color M by the exposure unit 12, image writing of the third color C by the exposure unit 12, and image writing of the fourth color K by the nearest exposure unit 12, are successively conducted.

(4) After image writing onto the reverse surface by the K exposure unit 12, located nearest to the transfer position B1, on the upstream side in the movement direction of the photoreceptor drum 10, viewed from the transfer position B1 of the transfer device 14*c*, has been completed, contact of the blade member 141 with the toner image receiving body 14*a*, is released.

(5) After contact of the blade member 141 with the toner image receiving body 14*a* has been released, image writing of the first color Y, corresponding to the obverse surface image of the recording sheet P, by Y exposure unit 12, located furthest to the transfer position B1 on the upstream side in the movement direction of the photoreceptor drum 10, viewed from the transfer position B1 of the transfer device 14*c*, is started, and image writing of the second color M by the exposure unit 12, image writing of the third color C by the exposure unit 12, and image writing of the fourth color K by the nearest exposure unit 12, are successively conducted.

(6) After image writing onto the obverse surface by the K exposure unit 12, located nearest to the transfer position B1, on the upstream side in the movement direction of the photoreceptor drum 10, viewed from the transfer position B1 of the transfer device 14*c*, has been completed, the blade member 141 is in contact with the toner image receiving body 14*a*.

(7) The above-described (2) through (6) are repeated, and the next image formation is conducted.

When the toner image receiving body 14*a* is stopped after the image formation has been completed, the toner image receiving body 14*a* is rotated at least more than one rotation, under the contact condition of the blade member 141.

Due to (3) through (6) described above, at the time of contact and contact-release of the blade member 141, image writing by each color exposure unit 12 onto the photoreceptor drum 10 is not conducted, and therefore, a shock caused at the time of contact and contact-release of the blade member 141, does not influence on the image writing by the each color exposure unit 12.

Further, due to (1) and (4) described above, distance L11 from the transfer position B1 of the transfer device 14*c* to the contact position A1 of the blade member 141 on the upstream side in the movement direction of the toner image receiving body 14*a*, is set to be longer than the distance L12 from the transfer position B1 of the transfer device 14*c* to the image writing position C1 by K exposure unit 12, located nearest to the transfer position B1, on the upstream side in the movement direction of the photoreceptor drum 10, and further, the contact of the blade member 141 is released after the completion of the image writing by the K exposure unit 12 onto the reverse surface. Thereby, the reverse surface image is not transferred onto the surface, onto which accumulated toner, formed on the toner image receiving body 14*a* at the time of contact-release of the blade member 141, has adhered.

When the distance L11 is set to be smaller than the distance L12, the reverse surface image is transferred onto the surface with the toner accumulation, resulting in inferior images. In order to avoid this problem, although the release of the blade member 141 can be delayed, copy speed is delayed in this case, which is disadvantageous.

Further, due to (2) and (3) described above, distance L11 from the transfer position B1 of the transfer device 14*c* to the contact position A1 of the blade member 141 on the upstream side in the movement direction of the toner image receiving body 14*a*, is set to be smaller than the distance L13 from the transfer position B1 of the transfer device 14*c* to the image writing position D1 by the exposure unit 12 of the first color Y, located furthest to the transfer position B1, on the upstream side in the movement direction of the photoreceptor drum 10, and further, image writing onto the reverse surface by the Y exposure unit 12 is started, under the condition that the blade member 141 is in contact with the toner image receiving body 14*a*. Thereby, the reverse surface image is transferred onto the cleaned surface on the toner image receiving body 14*a*.

When the distance L11 is set to be longer than L13, the reverse surface image is transferred onto the surface of the toner image receiving body 14*a* before cleaning by the blade member 141, resulting in inferior images. In order to avoid this problem, although image writing timing by the Y exposure unit 12 can be delayed, copy speed is also delayed in this case, which is a problem.

Further, due to the above-described (8), it can be prevented that the residue remaining on the toner image receiving body 14*a* is fused onto the receiving body by the heat from the fixing device 17.

When the toner image receiving body 14*a* is stopped before being rotated more than 1 rotation while the blade member 141 is in contact with the toner image receiving body 14*a*, because the toner image receiving body 14*a* is arranged close to the fixing device 17, the residue on the toner image receiving body 14*a* is fused by the heat from the fixing device 17, and the toner image, which is a reverse surface image, is transferred onto the toner image receiving body 14*a*, onto which the residue is fused, resulting in inferior images.

Figure 8:
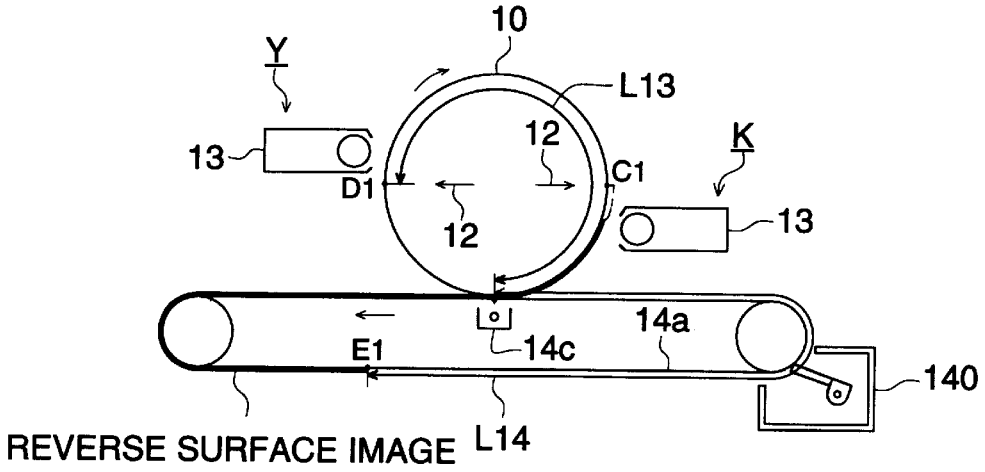
FIG. 8 is a view showing conditions to superimpose a reverse surface. Image on an obverse surface image.

Further, as another condition, as shown in FIG. 8, the distance L13 from the transfer position B1 of the transfer device 14*c* to the image writing position D1 by the Y exposure unit 12, located furthest to the transfer position B1, on the upstream side in the movement direction of the photoreceptor drum 10, is set to be smaller than the distance L14 from the position E1, at which the leading edge of the reverse surface image arrives, which is transferred onto the toner image receiving body 14*a*, when image writing, corresponding to the reverse surface image of the recording sheet P, has been completed by the K exposure unit 12, located nearest to the transfer position B1, to the transfer position B1 of the transfer device 14*c* on the downstream side in the movement direction of the toner image receiving body 14*a*.

When the distance L13 is set to be smaller than the distance L14, timing can be set so that the reverse surface image and the obverse surface image are aligned with each other and formed.

When the distance L13 is set to be larger than the distance L14, the obverse surface image arrives at the transfer position B1 of the transfer device 14*c* later than the reverse surface image, and timing can not be set so that the reverse surface image and the obverse surface image are aligned with each other and then formed. In this connection, when image writing, corresponding to the reverse surface, has been completed, the distance from the image writing position C1 by the K exposure unit 12, located closest to the transfer position B1, to the leading edge position E1 of the reverse surface image, transferred onto the toner image receiving body 14*a*, is equal to the length in which the maximum image size, for example, size A-3 or 2 sheets of size A-4, can be accommodated.

Figure 9:
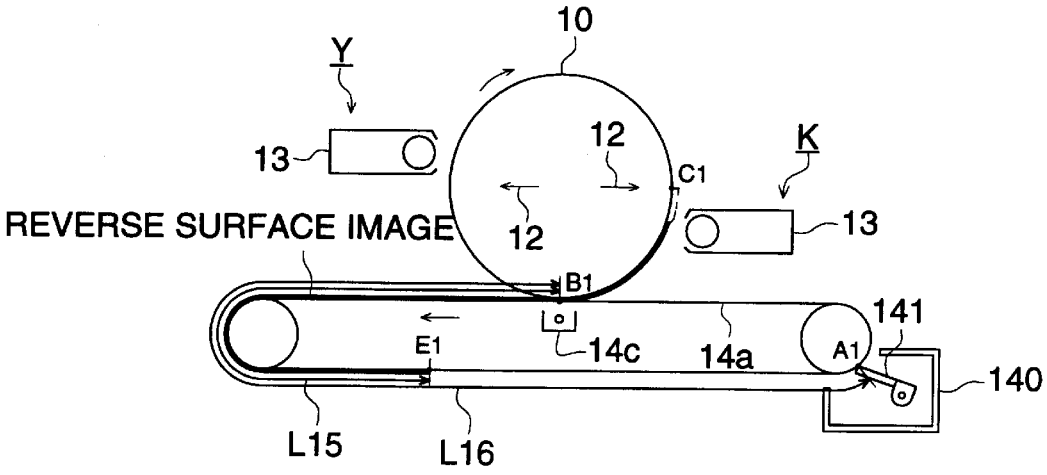
FIG. 9 is a view showing conditions in which the reverse surface image formed on a second image carrier means is not cleaned.

Further, as shown in FIG. 9, of course, the distance L16 from the transfer position B1 of the transfer device 14*c* to the contact position A1 of the blade member 141 on the downstream side in the movement direction of the toner image receiving body 14*a*, is larger than the distance L15 from the transfer position B1 of the transfer device 14*c* to the leading edge position E1 of the reverse surface image on the downstream side in the movement direction of the toner image receiving body 14*a*.

Due to this, in the present invention, in which one of conditions is to release the blade member 141 after image writing by the K exposure unit 12, located closest to the transfer position B1, has been completed, the reverse surface image formed on the toner image receiving body 14*a* is not cleaned by the blade member 141 of the toner image receiving body cleaning device 140.

Incidentally, in the present example, a method is used in which the first transfer means and the second transfer means are separately provided; color toner images are collectively transferred onto the obverse surface of the transfer material by the operation of the first transfer means; and color toner images are collectively transferred onto the reverse surface of the transfer material by the operation of the second transfer means.

In order to collectively transfer the toner image of each color, superimposed on each other, the polarity of the upper layer toner and the lower layer toner of the superimposed toner images, is preferably the same and their charged amounts are equal to each other. Accordingly, for the reverse surface image formation, the superimposed toner images are formed on the photoreceptor drum 10 using the toner with the same polarity and same charged amount; the superimposed toner images are collectively transferred onto the toner image receiving body 14*a* without changing the polarity; and the superimposed toner images on the toner image receiving body 14*a* are collectively transferred onto the recording sheet P without changing the polarity. This method is preferable for an increase of the transfer property.

Further, for the obverse surface image formation, the superimposed toner images formed on the photoreceptor drum 10 are collectively transferred onto the recording sheet P without changing the polarity, which is preferable for an increase of the transfer property of the obverse surface image formation.

A method in which the polarity of either of the superimposed toner images on the toner image receiving body 14*a*, or those on the photoreceptor drum 10, is reversed; the superimposed toner images on the photoreceptor drum 10 are transferred onto the upper surface side (obverse surface side) of the recording sheet P, simultaneously with the transfer of the superimposed toner images on the toner image receiving body 14*a* onto the lower surface side (reverse surface side) of the recording sheet P, results in the insufficiently reversed polarity of the lower layer toner when the polarity is reversed, or even when the polarity is reversed, the toner is not sufficiently charged, so that the charged amount of the toner is not equal to each other, resulting in transfer failure. Accordingly, this method is not preferable.

Figure 10:
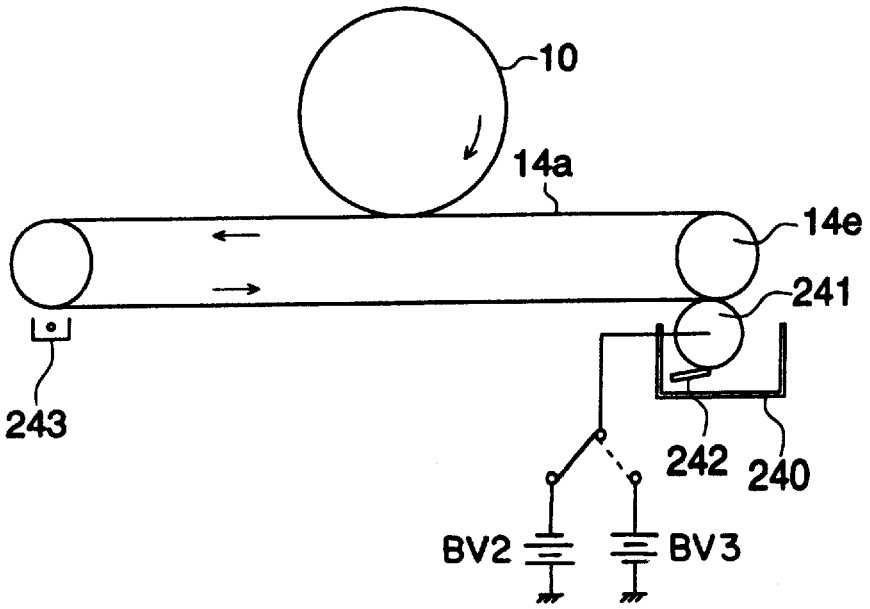
FIG. 10 is a view showing another example of the cleaning means.

Referring to FIG. 10, another example of the cleaning means for the toner image receiving body will be described below. FIG. 10 is a view-showing another example of the cleaning means.

Instead of the toner image receiving body cleaning blade 141 as the cleaning means for the toner image receiving body 14*a* described above, a toner image receiving body cleaning device 240 is used which is provided with a roller 241 which is always rotated at equal speed, comes into contact with the toner image receiving body 14*a*, and is opposed to the driven roller 14*e* which is electrically grounded.

When the toner image for the reverse surface, which has electric charges of negative polarity in the present example, is formed on the toner image receiving body 14*a*, and the toner image on the toner image receiving body 14*a* passes through the roller 241 portion, a bias voltage BV2 of −500 to −2 kVDC with the negative polarity, which is the same polarity as toner (in the present example, the negative polarity), is applied on the roller 241, and toner is repulsed, so that toner image passes through the roller 241 portion without being disturbed. Further, when the residual toner, remaining after transfer on the toner image receiving body 14*a*, is cleaned, the voltage is switched to the dotted line side, and a bias voltage E3 with the positive polarity reverse to the toner (in the present example, the positive polarity) is applied on the roller 241, so that toner is attracted and cleaned. The toner adhered to the roller is cleaned by the blade 242.

Because the cleaning performance of this cleaning is lower than the cleaning by the blade described above, a method may also be used, in which voltage with the same polarity as the toner (in the present example, the negative polarity) is applied by a re-charger 243 so that the polarity of the toner is equal to each other, and the toner attraction to the roller 241, on which the bias voltage BV3 with the positive polarity has been applied, is promoted.

Further, when cleaning is conducted, it may be effective that the rotational direction of the roller 241 is reversed so that the cleaning performance is increased.

EXAMPLE 2

Figure 11:
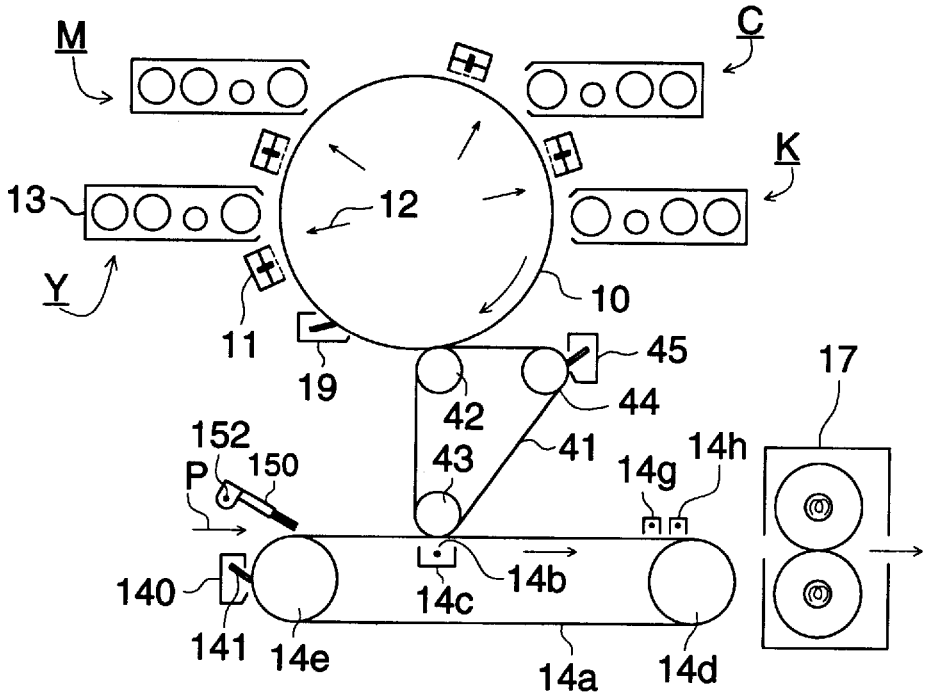
FIG. 11 is a sectional view of the structure of Example 2 of the image forming apparatus.

Referring to FIG. 11, the image forming process and each mechanism of the second example of the image forming apparatus of the present invention will be described below. FIG. 11 is a sectional view showing the structure of the second example of the image forming apparatus of the present invention. In the present example, the color toner image is formed on the image carrier by the same image forming process as in Example 1, and the color toner image on the image carrier is transferred onto the toner image receiving body or the transfer material through the intermediate transfer body. Accordingly, the arrangement of the toner image receiving body and the transfer material feeding direction are reverse to the image forming apparatus in Example 1. The same numeral is denoted to each member having the same function and structure as those, described in the image forming apparatus in Example 1.

A transfer belt 41, as an intermediate transfer body, is provided opposite the photoreceptor drum 10, serving as the image carrier. The transfer belt 41 is stretched around the first roller 42 which serves as a transfer roller to press the intermediate transfer belt 41 onto the photoreceptor drum 10, the second roller 43 which serves to press the intermediate transfer belt 41 onto the toner image receiving body 14*a* in the transfer area 14*b*, and a back-up roller 44. Numeral 45 is an intermediate transfer belt cleaning device.

In the same manner as described in Example 1 of the image forming apparatus, a superimposed color toner image is formed on the peripheral surface of the photoreceptor drum 10 during a single rotation, by the scorotron charger 11 as a charging means, the exposure unit 12 as an image exposure means, and developing device 13 as a developing means (the toner image forming means).

By the toner image forming means, a superimposed color toner image as the reverse surface image, is formed on the photoreceptor drum 10, which is the image carrier. After the superimposed color toner image, which is a reverse surface image, on the photoreceptor drum 10, has been temporarily transferred onto an intermediate transfer belt 41 (the first image carrier mean) by the transfer roller 42, it is collectively transferred onto a toner image receiving body 14*a* (the second image carrier means), which is stretched between the driving roller 14*d* and the driven roller 14*e*, and is provided close to the photoreceptor drum 10 or in contact with the drum, by the transfer device 14*c*, onto which a voltage having reverse polarity to the toner (positive polarity, in the present example) is applied, in the transfer area 14*b*.

The obverse image of the superimposed color toner image is again formed on the photoreceptor drum 10, and is transferred onto the intermediate transfer belt 41. It is necessary to change image data so that the obverse image formed at the time, forms a mirror image with respect to the reverse image on the image carrier.

The recording sheet P, as the transfer material, is sent to the transfer area 14*b*, in synchronization with the color toner image as the obverse image, which has been formed on the photoreceptor drum 10, once transferred on the intermediate transfer belt 41 and is carried thereon, and the color toner image as the reverse image carried on the toner image receiving body 14*a*. In this case, the recording sheet P, as the transfer material, is paper-charged to the same polarity as the toner by a paper charger 150, is attracted to the toner image receiving body 14*a*, and is sent to the transfer area 14*b*, wherein the paper charger 150 with a brush-like leading edge, as a transfer material charging means, can be in contact with and released from the toner image receiving body 14*a* by rotating around the support shaft 152, and is in contact with the recording sheet P. By paper-charging the recording sheet P to the same polarity as the toner, the recording sheet P is prevented from being attracted by the toner image on the toner image receiving body, or the toner image on the image carrier, so that the toner image remains undisturbed. Simultaneously with passage of the recording sheet P, the paper charger 150 is separated from the toner image receiving body 14*a*, and contact is released. Further, as the transfer material charging means, a conductive roller which can contact with and be removed from the toner image receiving body, or a corona charger separately provided from the toner image receiving body, may also be used.

The obverse image on the peripheral surface of the photoreceptor drum 10 is collectively transferred onto the upper surface side (the obverse surface side) of the recording sheet P by the transfer device 14*c*, as the first transfer means, onto which voltage with the reverse polarity as the toner (in the present example, positive polarity) is applied. In this case, the reverse image on the peripheral surface of the toner image receiving body 14*a* is not transferred onto the recording sheet P, and exists on the toner image receiving body 14*a*. Next, the reverse image on the peripheral surface on the toner image receiving body 14*a* is collectively transferred onto the lower surface side (the reverse surface side) of the recording sheet P, by a reverse surface transfer device 14*g*, as the second transfer means, onto which a voltage with the reverse polarity as the toner (in the present example, positive polarity) has been applied.

The recording sheet P, on both surfaces of which the color toner image has been formed, is discharged by a sheet separation AC discharger 14*h* for transfer material separation, separated from the toner image receiving body 14*a*, and is conveyed to a fixing device 17 as a fixing means, composed of 2 rollers respectively having a heater therein. Adhered toner on the obverse and reverse sides of the recording sheet P is fixed by application of the heat and pressure between two rollers; the obverse and reverse images are recorded on the recording sheet P, and the sheet P is delivered onto a tray provided outside the apparatus.

By using the above method, because superimposed color toner images are collectively transferred, color doubling of the color image on the toner image receiving body, toner scattering, or a frictional damage hardly occurs, so that excellent double-sided color images can be formed with smaller image deterioration.

In the image forming apparatus of the present example, toner remaining on the peripheral surface of the toner image receiving body 14*a* after transferring, is removed by a toner image receiving body cleaning blade 141 of a toner image receiving body cleaning device 140, which can be brought into contact with and can be removed from the toner image receiving body 14*a*, in the same manner as described in the image forming apparatus of the first example.

In the same manner as described in FIGS. 4 and 5, in also the image forming apparatus in the second example, various-type image forming operations such as cleaning of the toner image receiving body, charging of the recording sheet, cleaning using a roller, etc., are carried out. The double-side image formation is carried out by using a cleaning method in which image unevenness of the toner image, hardly occurs at the time of toner image formation or transfer, by the shock caused at the contact or contact-release of the cleaning means with respect to the toner image receiving body; a transfer method in which the reverse surface image is scarcely disturbed; and further, a toner image receiving body cleaning method in which a contact or contact-release operation is not necessary.

Further, in also the image forming apparatus of the second example described above, of course, a single surface copy is carried out by the first or the second image carrier means. Further, the present invention is not limited to the present system, but also includes variations by which double-sided images are formed. For example, the method in which processing conditions and image data processing conditions are changed with respect to the obverse surface and the reverse surface, as described above, can also be applied to the method, disclosed in Japanese Patent Publication No. 28740/1979, in which, relating to the reverse image, after the polarity of toner has been reversed, images are simultaneously transferred onto both surfaces of the transfer material, and also for the tandem method, disclosed in Japanese Patent Publication Open to Public Inspection Nos. 180969/1988, 298255/1988, 44457/1989, etc., so that the double-sided image formation in which the image density and the color tone are properly adjusted, can be carried out.

EXAMPLE 3

Figure 12:
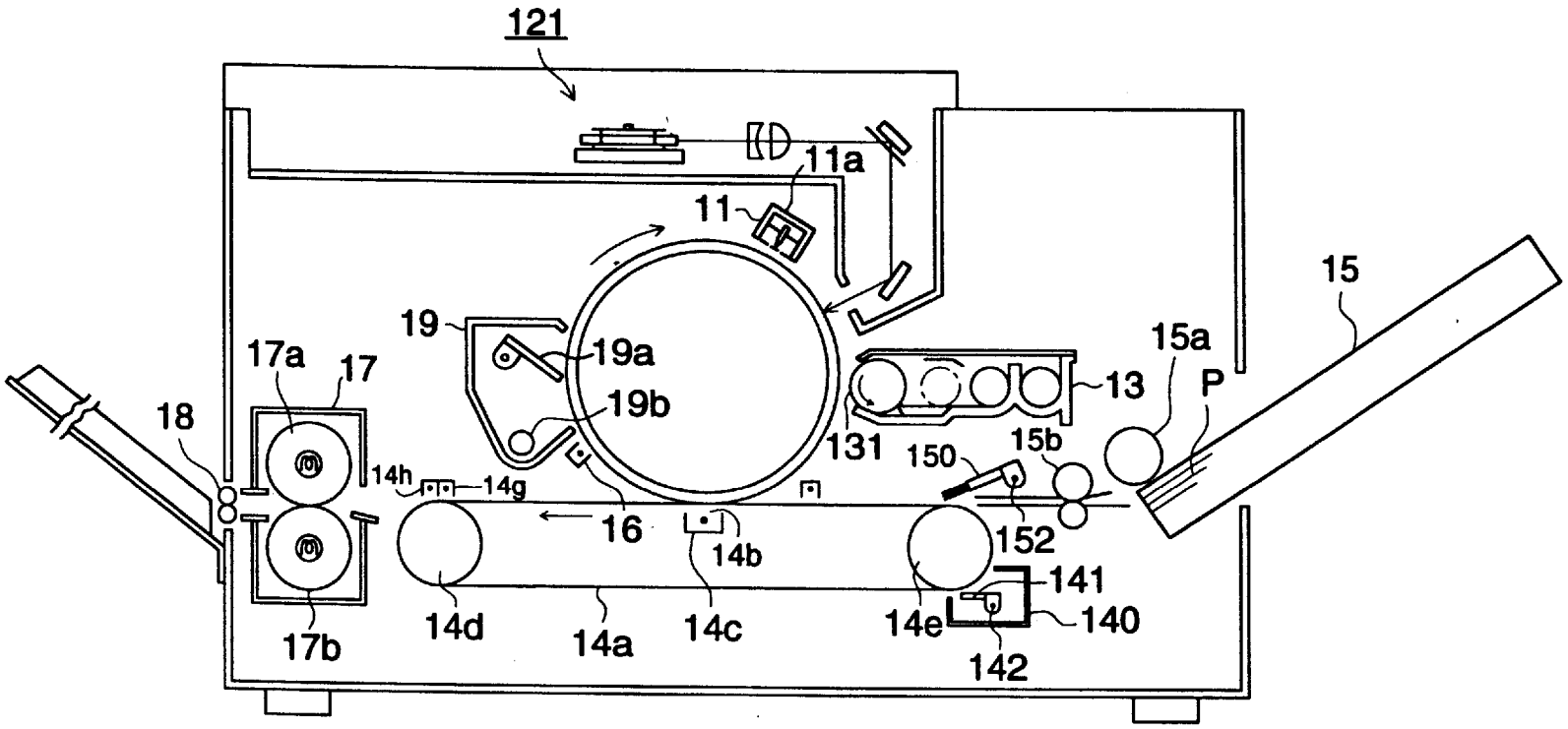
FIG. 12 is a sectional view of the structure of an image forming apparatus showing Example 2.
Figure 13:
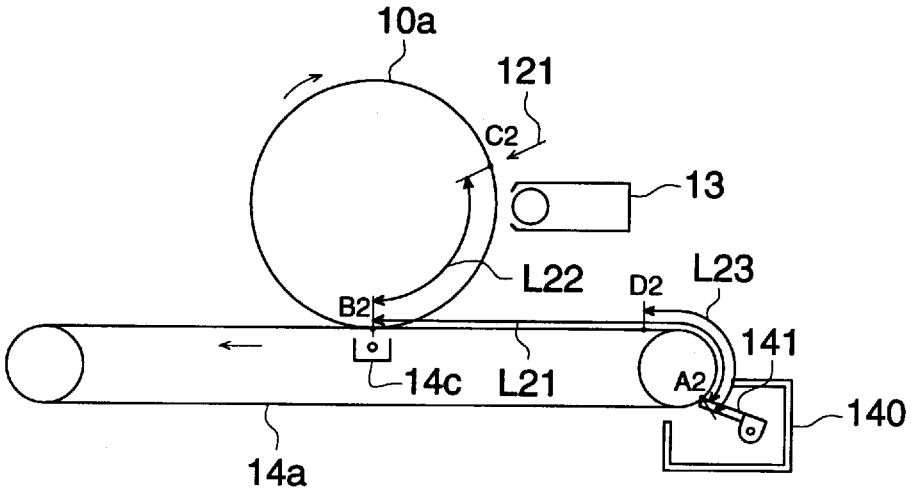
FIG. 13 is a view showing setting conditions of the contact position of the cleaning means and an image writing position of an image writing means in Example 2.
Figure 14:
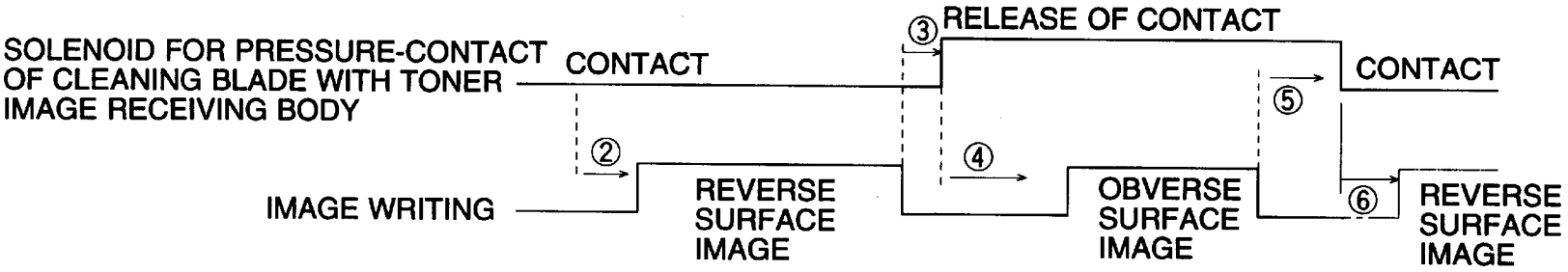
FIG. 14 is a time chart showing timing of contact and a release of contact of the cleaning means, and timing of image writing by the image writing means in Example 2.
Figure 15:
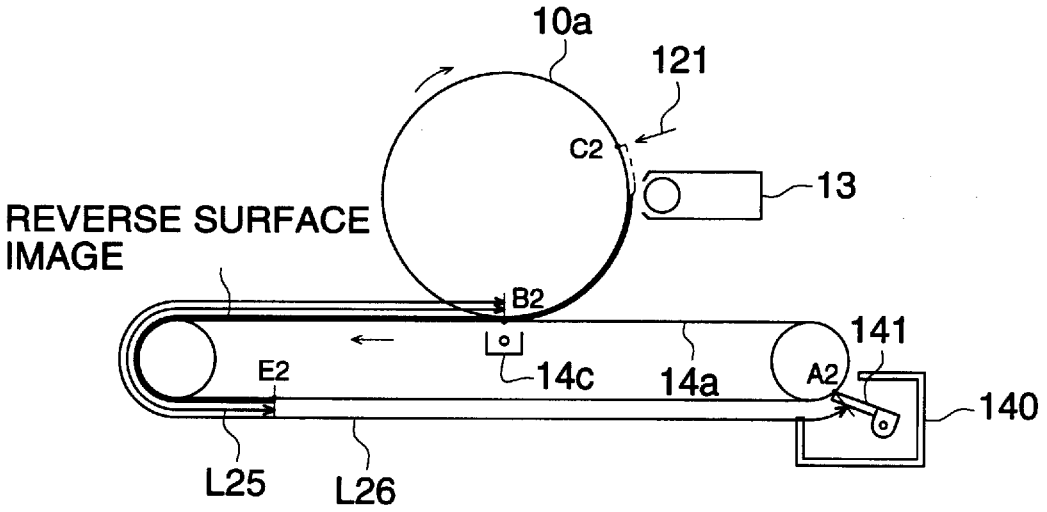
FIG. 15 is a view showing conditions in which the reverse surface image formed on a second image carrier means is not cleaned.

FIGS. 12 through 15 are views for explaining the third example of the image forming apparatus of the present invention. FIG. 12 is a sectional view showing the structure of the image forming apparatus of the third example. FIG. 13 is a view showing setting conditions of the contact position of the cleaning means and the image writing position by the image writing means, according to Example 3. FIG. 14 is a timing chart showing timing of contact and contact-release of the cleaning means, and timing of image writing by the image writing means. FIG. 15 is a view showing a condition in which the reverse image formed on the image carrier means of the third example, is not cleaned. The present example forms a monochromatic image, instead of the color image formation of Example 1. Members having the same function and structure as those described in the image forming apparatus of Example 1, are denoted by the same numerals.

Initially, referring to FIG. 12, an image forming apparatus and an image forming process of Example 3 will be described.

In the present example, a scorotron charger 11, an exposure unit 121, and a developing device 13 are sequentially arranged from the upstream side in the movement direction of a photoreceptor drum 10*a*. When image recording starts, the photoreceptor drum 10*a* is rotated clockwise in the arrowed direction by a photoreceptor driving motor, not shown, simultaneously, the scorotron charger 11 is operated, and a potential voltage is applied onto the photoreceptor drum 10*a*. Next, image writing is conducted on the photoreceptor drum 10*a*, onto which the potential voltage has been applied, by laser beams by the exposure unit 121, and an electrostatic latent image is formed on the photoreceptor drum 10*a*. The electrostatic latent image is reversal-developed by the developing device 13, and a toner image is formed on the photoreceptor drum 10*a* (a toner image forming means).

A toner image, which is a reverse surface image, is formed on the photoreceptor drum 10*a*, serving as the first image carrier means, by the image formation process described above. The toner image is transferred onto a toner image receiving body 14*a*, which serves as the second image carrier means, in a first transfer area 14*b*, by a transfer device 14*c*, which serves as the first transfer means, on which a DC voltage with the reverse polarity as toner (in the present example, the positive polarity) has been applied.

Toner remaining on the peripheral surface of the photoreceptor drum 10 after transferring is discharged by a photoreceptor drum AC discharger 16; is then moved into a photoreceptor drum cleaning device 19; scraped off by a photoreceptor drum cleaning blade 19*a*, made of a rubber material, being in contact with the photoreceptor drum 10*a*, and is collected into a waste toner container, not shown, by a screw 19*b*.

By the method as described above, after the toner image which is a reverse surface image, has been formed on the toner image receiving body 14*a*, serving as the second image carrier means, formation of a toner image which is an obverse surface image starts, in the same manner as the above image forming process, on the photoreceptor drum 10*a*, serving as the first image carrier means, from which the residual toner has been removed.

The recording sheet P, serving as the transfer material, is sent from the sheet feeding cassette 15, serving as a transfer material accommodation means, by a timing roller 15*b* through a feeding roller 15*a*. In this case, timing of the obverse surface image formation is adjusted with timing of feeding of the recording sheet P so that the toner image of the reverse surface image formed on the toner image receiving body 14*a*, the toner image of the obverse surface image formed on the photoreceptor drum 10*a*, and the recording sheet P are in timed relationship with each other, in the transfer area 14*b*.

The recording sheet P, sent in timed relationship with toner images by the timing roller 15*b*, is paper-charged to the same polarity as toner by a paper charger 150, serving as a transfer material charging means, onto which a DC voltage with the same polarity as toner (in the present example, the negative polarity) has been applied, and is attracted to the toner image receiving body 14*a*.

The recording sheet P attracted onto the toner image receiving body 14*a* by the paper-charger 150, is sent to the first transfer area 14*b*. In the first transfer area 14*b*, the toner image of the obverse surface image on the photoreceptor drum 10*a*, is transferred onto the upper surface side (the obverse surface side) of the recording sheet P by the transfer device 14*c*, serving as the first transfer means, onto which a voltage with the reverse polarity to the toner (in the present example, the positive polarity) has been applied. Incidentally, the toner image of the reverse surface image on the toner image receiving body 14*a* is not transferred onto the recording sheet P, and remains on the toner image receiving body 14*a*.

The recording sheet P, onto which the toner image of the obverse surface image has been transferred, is conveyed to the second transfer area, accompanied with movement of the toner image receiving body 14*a*, while being attracted onto the toner image receiving body 14*a*. In the second transfer area, the toner image of the reverse surface image on the toner image receiving body 14*a* is transferred onto the lower surface side (the reverse surface side) of the recording sheet P by a reverse surface transfer device 14*g*, serving as the second transfer means, which is arranged opposite the electrically grounded driven roller 14*d*, and onto which a voltage with the reverse polarity to the toner (in the present example, the positive polarity) has been applied.

As described above, the recording sheet P, on both surfaces of which the toner images have been transferred, is discharged by a sheet separation AC discharger 14*h* for transfer material separation, which is arranged opposite the electrically grounded driven roller 14*d*, and onto which an AC voltage or a superimposed voltage of AC and DC voltages has been applied, and is separated from the toner image receiving body 14*a*.

The recording sheet P, separated from the toner image receiving body 14*a*, is conveyed to a fixing device 17 as a fixing means having 2 rollers 17*a* and 17*b*, respectively housing a heater, and after the toner, adhered to the obverse and reverse surfaces of the recording sheet P, has been fixed by heat and pressure, the recording sheet P is delivered onto a tray provided outside the apparatus, through the delivery sheet roller 18.

The toner, remained on the toner image receiving body 14*a* after the toner image of the reverse surface image has been transferred onto the recording sheet P, is cleaned by a toner image receiving body cleaning device 140, serving as a cleaning means, which is provided opposite the driven roller 14*e*, and has a blade member 141 which is rotated around the support shaft 142 and can be in contact with and contact-released from the toner image receiving body 14*a*. In this connection, the contact and contact-release operations of the blade member 141 are conducted by ON and OFF operations of a pressure contact solenoid, not shown.

Further, the toner, remaining on the photoreceptor drum 10*a* after the toner image of the obverse surface image has been transferred onto the recording sheet P, is removed by a photoreceptor drum cleaning device 19, after being discharged by a photoreceptor drum AC discharger 16, in the same manner as the reverse surface image formation, and the next image formation cycle starts.

In the above image forming apparatus, images are formed on both surfaces of the recording sheet P as described above, and of course, the image can be formed on only the obverse surface or the reverse surface of the recording sheet P.

Next, referring to FIGS. 13 and 14, setting conditions of the contact position of the blade member 141 of the toner image receiving body cleaning device 140, which serves as the cleaning means, with the toner image receiving body 14*a*, and the image writing position of an exposure unit 12 which is an image writing means; contact and contact-release timing of the blade member 141 and image writing timing by the exposure unit 12; and conditions necessary when the toner image receiving body 14*a* is stopped, which are major objects of the present invention, will be described.

(1) Distance L21 from the transfer position B2 of the transfer device 14*c* to the contact position A2 of the blade member 141 on the upstream side in the movement direction of the toner image receiving body 14*a*, is set to be longer than the distance L22 from the transfer position B2 of the transfer device 14*c* to the image writing position C2 by an exposure unit 121 on the upstream side in the movement direction of the photoreceptor drum 10*a*, (L21>L22).

(2) Image writing, corresponding to the reverse surface image of the recording sheet P, by the exposure unit 121, starts while the blade member 141 is in contact with the toner image receiving body 14*a*.

(3) In Item (2), it is preferable that image writing, corresponding to the reverse surface image of the recording sheet P, by the exposure unit 121, starts while the blade member 141 is in contact with the toner image receiving body 14*a*, after one point on the toner image receiving body 14*a*, has moved by the distance L23 obtained by subtracting the distance L22 from the distance L21, (L23=L21−L22), (for example, point A2 moves to position D2).

(4) After image writing onto the reverse surface by the exposure unit 121 has been completed, the contact of the blade member 141 with the toner image receiving body 14*a* is released.

(5) After the contact of the blade member 141 with the toner image receiving body 14*a* has been released, image writing by the exposure unit 121 starts corresponding to the obverse surface of the recording sheet P.

(6) After the image writing by the exposure unit 121 has been completed corresponding to the obverse surface, the blade member 141 comes into contact with the toner image receiving body 14*a*.

(7) The above items (2) through (6) are repeated, and the next image formation is conducted.

(8) When the toner image receiving body 14*a* is stopped after the completion of image formation, the toner image receiving body 14*a* is rotated at least more than one rotation, while the blade member 141 is in contact with the toner image receiving body 14*a*.

Due to the above items (2), and (4) through (6), when the blade member 141 is brought into contact with and removed from the toner image receiving body 14*a*, image writing by the exposure unit 121 onto the photoreceptor drum 10*a* is not conducted. Thereby, the shock, caused at the time of the contact and contact-release of the blade member 141, does not influence on the image writing by the exposure unit 121.

Further, due to the above items (1) and (4), distance L21 from the transfer position B2 of the transfer device 14*c* to the contact position A2 of the blade member 141 on the upstream side in the movement direction of the toner image receiving body 14*a*, is set to be longer than the distance L22from the transfer position B2 of the transfer device 14*c* to the image writing position C2 by an exposure unit 121 on the upstream side in the movement direction of the photoreceptor drum 10, and the contact of the blade member 141 is released after the completion of image writing onto the reverse surface by the exposure unit 121. Accordingly, the reverse surface image is not transferred onto the surface onto which toner accumulation adheres, wherein the toner is accumulated on the toner image receiving body 14*a* when contact of the blade member 141 is released.

When the distance L21 is set to be smaller than the distance L22, the reverse surface image is transferred onto the surface onto which the toner accumulation adhered, resulting in image failure. In order to avoid this problem, although release of the blade member 141 is delayed, copy speed is slower in this case, which is a problem.

Further, due to the above Item (3), image writing, corresponding to the reverse surface image of the recording sheet P, by the exposure unit 121, starts while the blade member 141 is in contact with the toner image receiving body 14*a*, after one point on the toner image receiving body 14*a*, has moved by the distance L23 obtained by subtracting the distance L22 from the distance L21, (L23=L21−L22), (for example, point A2 moves to position D2). Accordingly, the reverse surface image is transferred onto the cleaned surface of the toner image receiving body 14*a*.

When image writing, corresponding to the reverse surface, by the exposure unit 121 starts before one point on the toner image receiving body 14*a*, has moved by the distance L23 (for example, point A2 moves to position D2), the reverse surface image is transferred onto the surface on the toner image receiving body 14*a* before cleaning by the blade member 141, resulting in image failure.

Further, due to the above Item (8), the residue remaining on the toner image receiving body 14*a* can be prevented from fusing by the heat from the fixing device 17.

When the toner image receiving body 14*a* is stopped before it is rotated more than one rotation under contact of the blade member 141, the residue remaining on the toner image receiving body 14*a* is fused by the heat from the fixing device 17, because the toner image receiving body 14*a* is placed close to the fixing device 17, and therefore, the toner image which is the reverse surface image, is transferred onto the toner image receiving body 14*a* on which the residue has been fused, results in image failure.

As other conditions, it is of course that, as shown in FIG. 15, the distance L26 from the transfer position B2 of the transfer device 14*c* to the contact position A2 of the blade member 141 on the downstream side in the movement direction of the toner image receiving body 14*a*, is longer than the distance L25 from the transfer position B2 of the transfer device 14*c* to the leading edge position E2 of the reverse surface image on the downstream side in the movement direction of the toner image receiving body 14*a*. Due to this, in the present invention having a major condition in which the blade member 141 is withdrawn after image writing by the exposure unit 121 has been completed, the reverse surface image, formed on the toner image receiving body 14*a*, is not removed by the blade member 141 of the toner image receiving body cleaning device 140.

The distance from the image writing position C2 by the exposure unit 121 when the image writing corresponding to the reverse surface has been completed, to the leading edge position E2 of the reverse surface image, transferred onto the toner image receiving body 14*a*, is the length, in which the maximum image size, for example, size A-3 or 2 sheets of size A-4, can be accommodated.

As described above, according to the present invention, because image writing is not conducted at the time of contact or contact-release of the cleaning means, the first image carrier means is not influenced, during image writing, by the mechanical shock caused at the time of contact or contact-release of the cleaning means, and thereby, the image writing is not disturbed. Further, the toner image, which is a reverse surface image, is transferred onto the surface of the second image carrier means, which is cleaned just before the toner image is transferred, and on which toner accumulation has not been formed, and thereby, excellent double-sided color images can be obtained without any disturbance of image writing, any toner accumulation, nor any influence by stains remaining on the second image carrier means.

Further, image writing is not conducted at the time of contact or contact-release of the cleaning means, and thereby, the first image carrier means is not influenced, during image writing, by mechanical shock caused at the time of contact or contact-release of the cleaning means, and the image writing is not disturbed. Still further, the toner image, which is the reverse surface image, is transferred onto the surface on the second image carrier means on which no toner accumulation has been formed, and thereby, excellent double-sided images can be obtained which is not influenced by image writing disturbance or toner accumulation.

Still further, the second image carrier means is cleaned just before the toner image is transferred, and the toner image, which is the reverse surface image, is transferred onto the cleaned surface of the second image carrier means, and thereby, excellent double-sided images, having no influence by stains remained on the second image carrier means, can be obtained.

Yet further, the second image carrier means is stopped after the entire peripheral surface of the second image carrier means has been cleaned, and thereby, even when the second image carrier means and the fixing means are arranged close to each other, the residue is not fused on the second image carrier means, and excellent double-sided images, having no influence by fusion of residue, can be obtained.

EXAMPLE 4

Next, referring to FIGS. 16(A) through 16(C), charging processes of the transfer material charging means, at the time of double-sided image formation, will be described.

As shown in FIGS. 16(A) and 16(B), the paper charger 150 as the transfer charging means, is rotated around the support shaft 152 and contacted with the recording sheet P when the recording sheet P is synchronized with the leading edge of the reverse surface image and enters into the toner image receiving body 14*a*, and the contact is released just before the trailing edge of the recording sheet P passes through the toner image receiving body 14*a*. A bias voltage E1 of −500 to −2 kVDC having the same polarity as toner (in the present example, negative polarity) is applied during the contact of the paper charger 150, and the application of the bias voltage BV1 is stopped simultaneously with or just after the contact-release. During the above operations, the driven roller 14*e* is electrically grounded.

Figure 16:
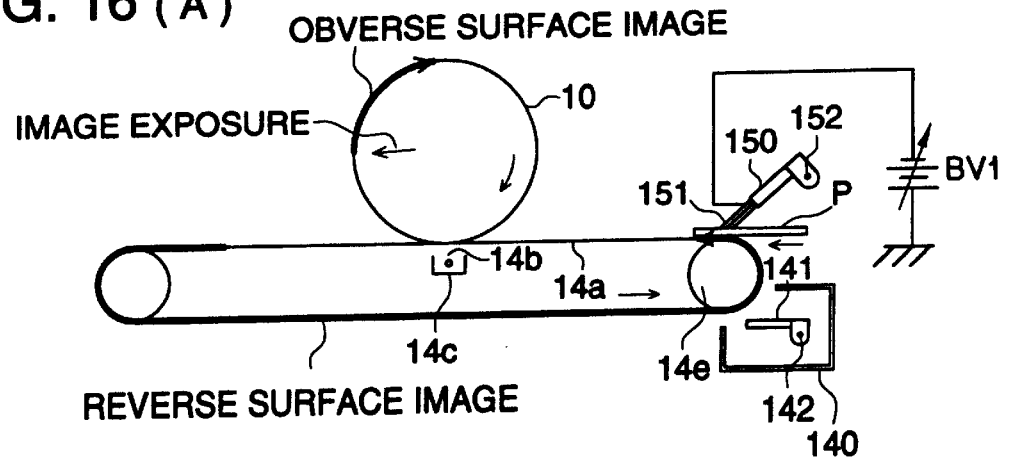
FIGS. 16(A) to 16(C) views showing timing of contact of a transfer material charging means with the toner image receiving body.
Figure 16:
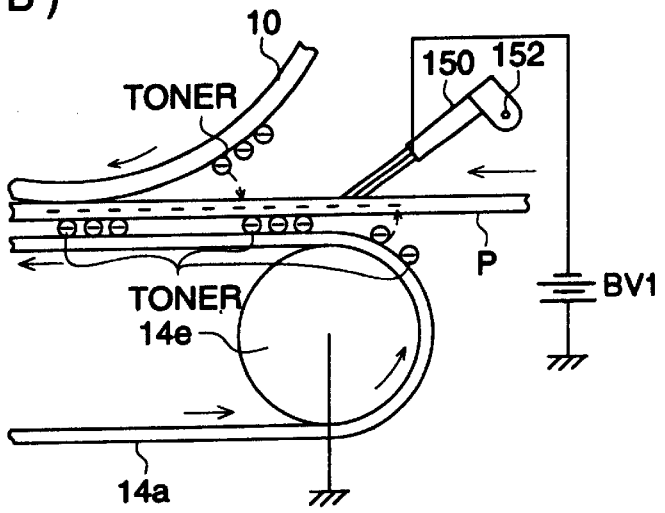
Figure 16:
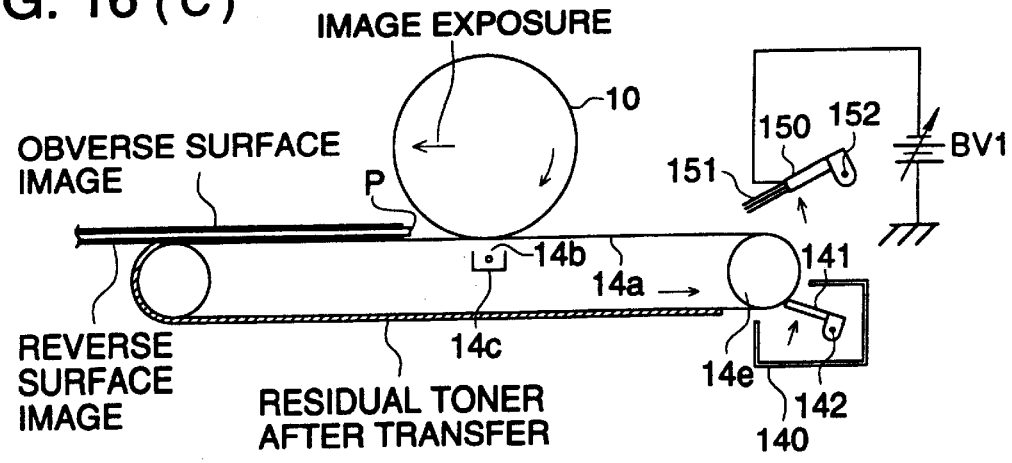

The recording sheet P is conveyed by the electrically grounded driven roller 14*e* and by being attracted to the toner image receiving body 14*a*, wherein the recording sheet P is charged to a negative polarity by positive charges, induced on the toner image receiving body 14*a* by the application of the bias voltage E1 with the negative polarity, which is the same polarity as the toner, on the paper charger 150. In this case, because the recording sheet P is negatively charged and conveyed, toner having negative charges on the toner image receiving body 14*a*, or toner having negative charges on the photoreceptor drum 10, is repelled by negative charges of the recording sheet P. Thereby, as shown in FIG. 16, the toner (with negative polarity) is not attracted to the recording sheet P, and specifically, image disturbance by toner movement, caused when the recording sheet P is charged to positive polarity, does not occur.

As another method of application of bias voltage , the same charging effects can also be obtained by a method in which the transfer material charging means is electrically grounded, and application of voltage, with the same positive polarity as toner and approximately equal voltage to that of the toner, onto the driven roller 14*e*, is controlled.

The paper charging brush 150 is rotated and brought into the condition of contact-release from the toner image receiving body 14*a*, just before passage of the trailing edge of the recording sheet P or simultaneously with its passage, and is moved into a non-charging position, separated from the recording sheet P, as shown in FIG. 16(C).

In this case, at the non-charging position, it is preferable that application of the bias voltage BV1 is carried out onto the paper charging brush 150 such that the voltage with the same polarity as toner, for example, the bias voltage BV1 of −500 VDC to −2 KVDC, which is approximately the same as the voltage at the time of contact, is applied onto the brush member 151 of the paper charging brush 150, not only when the recording sheet P is conveyed, but also when the recording sheet P is separated. When an AC component (500 Hz to 10 kHz, 100 $V_{p-p}$ to 1000 $V_{p-p}$) is superimposed at the time of contact or contact-release, toner adhering to the paper charging brush 150 can be further prevented.

When the paper charging brush 150, as the transfer material charging means, is separated from the toner image receiving body 14*a*, toner adhering to the paper charging brush 150 from the toner image receiving body 14*a*, can be prevented. Together wit h the above, when the voltage with the same polarity as the toner is applied onto the paper charging brush 150, the movement of toner from the toner image receiving body 14*a* to the paper charging brush 150, is suppressed, and toner staining of the paper charging brush 150 is prevented. Specifically, when the toner accumulation, formed when the contact of the blade member 141 of the toner image receiving body cleaning device 140 is released, passes through a paper charging brush 150 portion, it is necessary to release the contact of the paper charging brush 150 with the toner image receiving body 14*a* so that the paper charging brush 150 is not stained.

As described above, when the recording sheet P passes, the paper charging brush 150 is in contact with the toner image receiving body 14*a*, and is in contact with the recording sheet P. The movement of separation of the paper charging brush 150 from the charging position, at which the paper charging brush 150 is in contact with the recording sheet P and a bias voltage BV1 is applied, is synchronized with passage of the recording sheet P at the brush member 151 portion of the paper charging brush 150 as the transfer material charging means. When the recording sheet P does not pass, the paper charging brush 150 is removed from the toner image receiving body 14*a*, and separated from the recording sheet P. The movement of separation of the paper charging brush 150 from the non-charging position, at which the paper charging brush 150 is separated from the recording sheet P and a bias voltage BV1 is preferably applied, is synchronized with passage of the recording sheet P, at the brush member 151 portion of the paper charging brush 150 as the transfer material charging means. When the contact of the blade member 141 of the toner image receiving body cleaning device 140 is released, the paper charging brush 150 is preferably positioned, at least, at the non-charging position.

Figure 17:
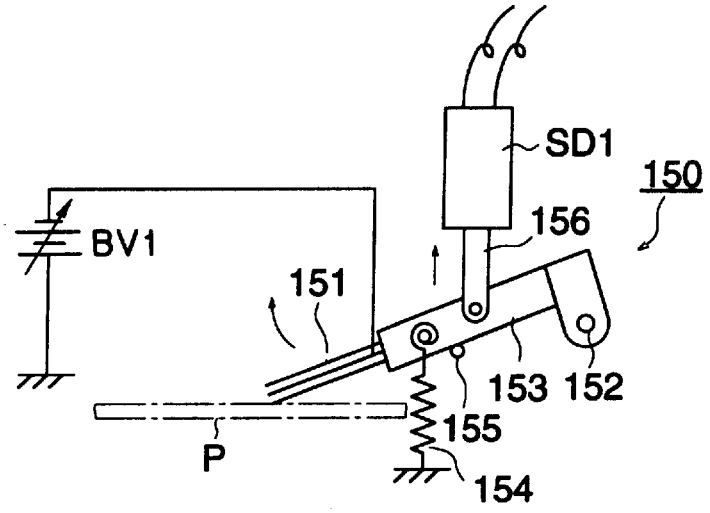
FIG. 17 is a view showing a first example of the transfer material charging means, and its contact and release of contact.

The contact and contact-release mechanism of the paper charging brush 150, as the transfer material charging means, is shown in FIG. 17. The paper charging brush 150 is composed of the brush member 151 and a holder 153, and is rotated around the support shaft 152. At the charging position when the recording sheet P passes, the holder 153 is pulled to a contact position of a stopper 155 toward the toner image receiving body 14*a*, by a spring 154, one end of which is attached to the apparatus main body, and the other end of which is attracted to the holder 153. The holder 153 is in contact with the toner image receiving body 14*a*, and the brush member 151 is in contact with the recording sheet P.

At the non-charging position when the recording sheet does not pass, a solenoid SD1 is activated in synchronization with the conveyance timing of the recording sheet P, and a lever 156 of the solenoid SD1, attached to the holder 153, is pulled, so that the paper charging brush 150 is rotated in the arrowed direction in FIG. 17. The paper charging brush 150 is removed from the toner image receiving body 14*a* on which the recording sheet P is conveyed, and separated from the recording sheet P.

When the paper charging brush 150 is separated from the toner image receiving body 14*a*, the movement distance of the leading edge portion of the brush member 151 of the paper charging brush 150 from the toner image receiving body 14*a* is preferably more than 1 mm and less than 10 mm at the closest distance. When the movement distance is less than 1 mm, there is a possibility in that the toner accumulation on the toner image receiving body 14*a* comes into contact with the leading edge portion of the brush member 151, and when more than 10 mm, the brush member 151 comes into contact with the peripheral members, which are not preferable.

Figure 18:
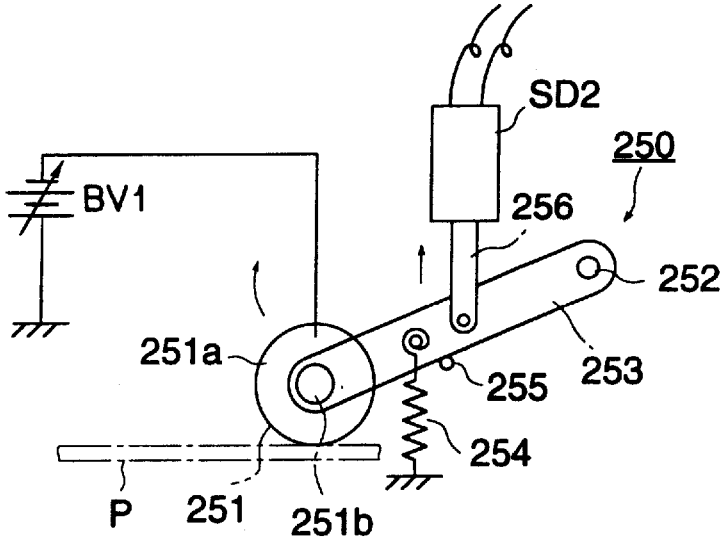
FIG. 18 is a view showing a second example of the transfer material charging means, and its contact and release of contact.
Figure 19:
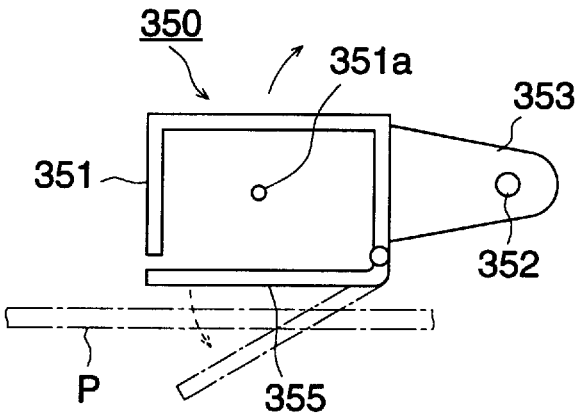
FIGS. 19(A) and 19(B) views showing a third example of the transfer material charging means.
Figure 19:
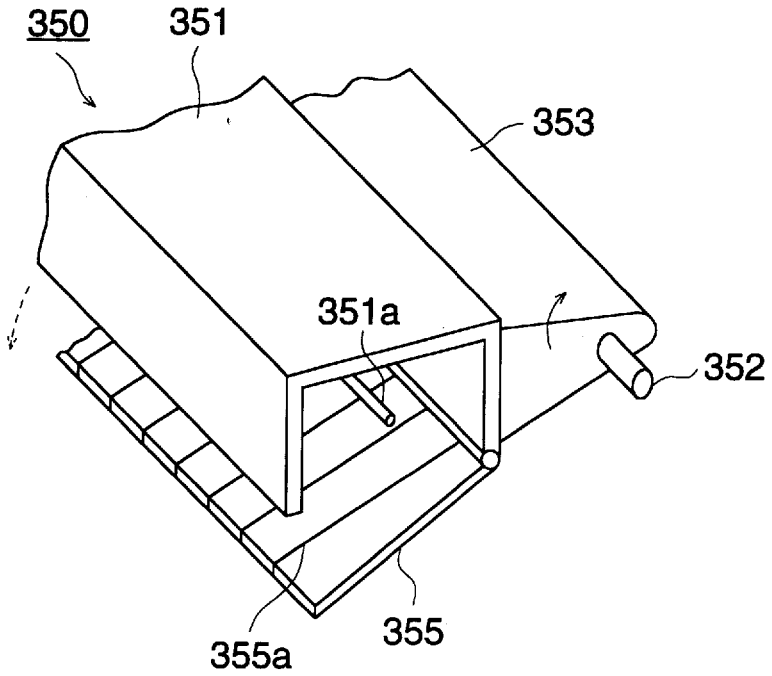

Other examples of the transfer material charging means will be described below, referring to FIGS. 18 and 19. FIG. 18 is a view showing the second example of the transfer material charging means, and its contact and contact-release mechanisms. FIG. 19 is a view showing the third example of the transfer material charging means. FIG. 19(A) is a sectional view of the transfer material charging means of the third example. FIG. 19(B) is a perspective view of the transfer material charging means of the third example.

As shown in FIG. 18, in the second example, a paper charging roller 250 is used as the transfer material charging means, and as the contact and contact-release mechanisms with respect to the toner image receiving body 14*a*, the same mechanisms as those described in FIG. 17 are used. The charging position at the time of contact with the recording sheet P as the transfer material, and the non-charging position at the time of separation from the recording sheet P, when the paper charging roller 250 is in contact with or removed from the toner image receiving body 14*a*, are the same as those described in FIG. 17, and are used in the same processes as described in the above-described image forming apparatus.

The paper charging roller 250 as the transfer material charging means, is composed of a roller member 251 and the holder 253. The roller member 251 is composed of a shaft 251*b* and a conductive rubber roller 251*a*, provided on the outer periphery of the shaft 251*b*. The shaft 251*b* is attached to the holder 253 such that the rubber roller 251*a* can be rotated.

The paper charging roller 250 is rotated around a support shaft 252, and at the charging position when the recording sheet P passes, the holder 253 is pulled to a contact position of the stopper 255 toward the toner image receiving body 14*a* by a spring 254, one end of which is attached to the apparatus main body, and the other end of which is attracted to the holder 253, and is in contact with the toner image receiving body 14*a*, so that the rubber roller 251*a* is in contact with the recording sheet P.

In the charging position, simultaneously with the contact, the bias voltage BV1 is applied on the paper charging roller 250. During the contact of the paper charging roller 250, the bias voltage BV1 of −500 to −2 kVDC with the same polarity as toner (in the present example, the negative polarity) is applied on the roller member 251.

Just before the passage of the trailing edge of the recording sheet P, or simultaneously with the passage of the trailing edge of the recording sheet P, the contact of the paper charging roller 250 is released from the toner image receiving body 14*a*, and the paper charging roller 250 is moved to the non-charging position, separated from the recording sheet P.

At the non-charging position when the recording sheet does not pass, a solenoid SD2 is activated in synchronization with the conveyance timing of the recording sheet P, and a lever 256 of the solenoid SD2, attached to the holder 253, is pulled, so that the paper charging roller 250 is rotated in the arrowed direction in FIG. 5. The paper charging roller 250 is removed from the toner image receiving body 14*a* on which the recording sheet P is conveyed, and is separated from the recording sheet P.

In this case, at the non-charging position, the bias voltage BV1 is preferably applied onto the paper charging roller 250 as follows: the bias voltage BV1 of, for example, −500 VDC to −2 kVDC which is approximately the same as that at the time of contact, is applied onto the roller member 251 of the paper charging roller 250, not only when the recording sheet P is conveyed, but also when the roller 250 is separated from the recording sheet P.

When the rubber roller 251*a* of the paper charging roller 250 is separated from the toner image receiving body 14*a*, the distance of movement of the rubber roller 251*a* of the paper charging roller 250 from the toner image receiving body 14*a* is preferably between 1 and 10 mm at the closest distance. When the distance of movement is less than 1 mm, there is a possibility in which the toner accumulation on the toner image receiving body 14*a* comes into contact with the rubber roller 251*a*, and when it is more than 10 mm, the roller member 251 comes into contact with the peripheral members, which are not preferable.

When the paper charging roller 250 is separated from the toner image receiving body 14*a*, the toner from the toner image receiving body 14*a*, is prevented from adhering onto the paper charging roller 250. Further, when voltage with the same polarity as the toner is applied onto the paper charging roller 250, flying of toner, on the toner image receiving body 14*a*, onto the paper charging roller 250 is repulsed, so that toner stain of the paper charging roller 250 is prevented. Specifically, as described above, when toner accumulation, formed by the contact-release of the blade member 141 of the toner image receiving body cleaning device 140, passes through the paper charging roller 250 portion, it is necessary to release the contact of the paper charging roller 250 so that the paper charging roller 250, specifically, the rubber roller 251*a* is not stained.

As described above, when the recording sheet P passes, the paper charging roller 250 is in contact with the toner image receiving body 14*a*, and is in contact with the recording sheet P. The movement of separation of the paper charging roller 250 from the charging position, at which the paper charging roller 250 is in contact with the recording sheet P and a bias voltage BV1 is applied, is synchronized with passage of the recording sheet P at the roller member 251 portion of the paper charging roller 250 as the transfer material charging means. When the recording sheet P does not pass, the paper charging roller 250 is withdrawn from the toner image receiving body 14*a*, and separated from the recording sheet P. The movement of separation of the paper charging roller 150 from the non-charging position, at which the paper charging roller 250 is separated from the recording sheet P and a bias voltage BV1 is preferably applied, is synchronized with passage of the recording sheet P, at the roller member 251 portion of the paper charging roller 250 which serves as the transfer material charging means. When the contact of the blade member 141 of the toner image receiving body cleaning device 140 is released, the paper charging roller 250 is preferably positioned, at least, at the non-charging position.

As shown in FIG. 19, a non-contact type corona discharger 350 may also be used as the transfer material charging means.

The corona discharger 350 is composed of a shield member 351 and a wire electrode 351*a* as a corona discharging electrode. A holder 353 is provided on the side end portion of the shield member 351. The corona discharger 350 can be moved from the charging position shown in FIG. 19(A), to the non-charging position, to which the corona discharger 350 is rotated around a support shaft 352, provided on the holder 353, in the arrowed direction by a rotation means, not shown.

The corona discharger 350 conducts corona discharging on the recording sheet P simultaneously with the entry of the recording sheet P into the charging position, stops the corona discharging simultaneously with the passage of the recording sheet P, and is moved by rotating to the non-charging position. By the movement of the corona discharger 350 to the non-charging position, toner stain is prevented.

Numeral 355 is a bridge to prevent the entry of the recording sheet P into the corona discharger 350 and also to prevent staining of the wire electrode 351*a*. Inside the bridge 355, wires 355*a* using, for example, nylon wires, are stretched.

The bridge 355 can be opened by rotating around one end of the shield member in the direction shown by the dotted arrow, and cleaning can also be conducted by opening the bridge 355 in the non-charging position.

In the above example, the transfer material charging means has been described to be under a contact or contact-release condition with respect to the second image carrier means, however, it may also be under a closely arranged condition, and a separated condition with respect to the second image carrier means.

EXAMPLE 5

Figure 20:
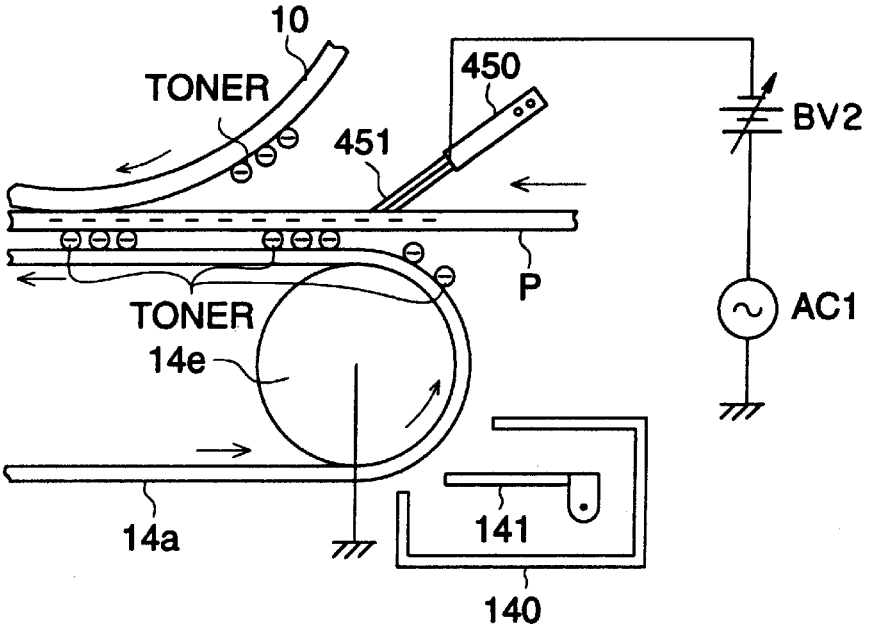
FIG. 20 is a view showing a charging process of the transfer material charging means.
Figure 21:
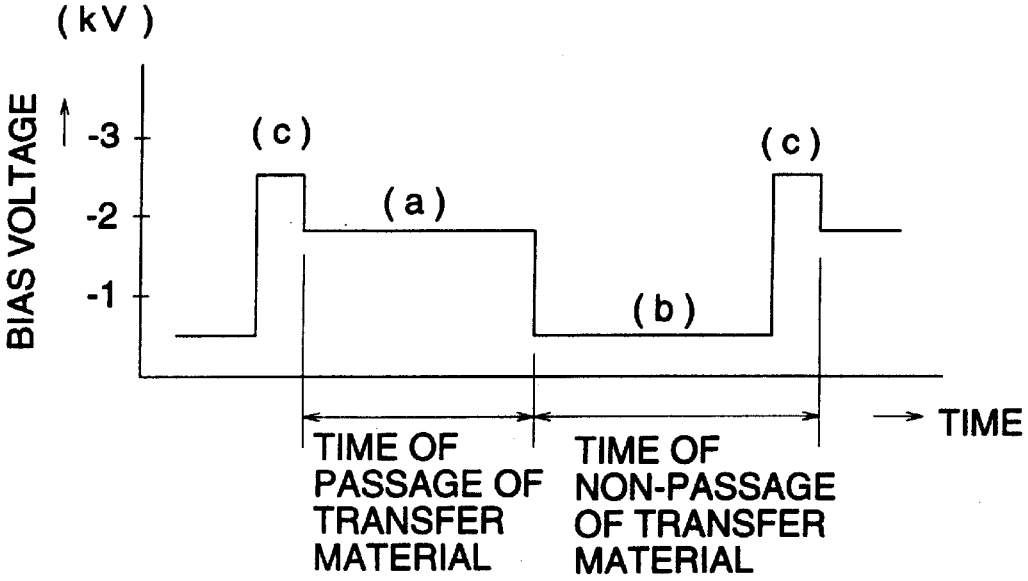
FIG. 21 is a view showing a timing chart of a bias voltage application.
Figure 22:
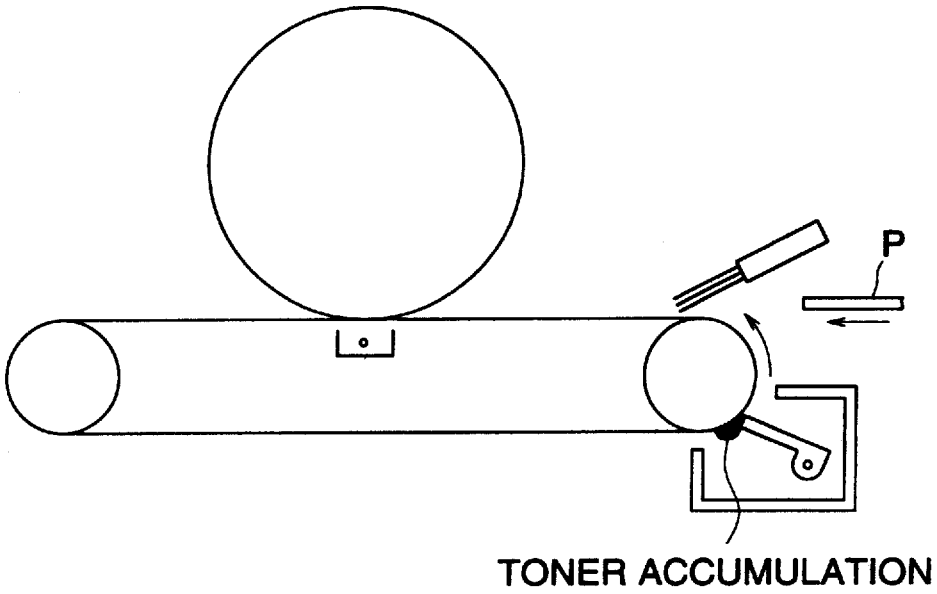
FIG. 22 is a view showing conventional problems.

Referring to FIGS. 20, 21, 1 and 2, the second example to prevent staining of the transfer material charging means, will be described below. FIG. 20 is a view showing a charging process of the transfer material charging means, and FIG. 21 is a timing chart of the bias voltage.

In also the present example, the same image forming process and mechanisms as those described in FIGS. 1 and 2 of Example 1, are used. In the present example, instead of the rotatable paper charging brush 150 as the transfer material charging means in the above-described Examples, a fixed paper charging brush 450 is used to prevent staining. The same numerals are denoted for the members having the same function and structure as described in Example 1.

The paper charging brush 450 as the transfer material charging means, is fixed in such a manner that it is in contact with or close to the toner image receiving body 14*a*. When the recording sheet P is in timed relationship with the leading edge of the reverse surface image, and enters the toner image receiving body 14*a*, a bias voltage E2 of, for example, −1 kVDC to −3 kVDC, as shown in FIG. 21(*c*), which is the highest voltage, with the same polarity as the toner (in the present example, negative polarity), is applied to the paper charging brush 450, just before the entry of the recording sheet P, so that repulsion against the toner on the toner image receiving body 14*a* is increased highest, and staining of the paper charging brush 450 is prevented, or toner adhered to the paper charging brush 450 is moved to the toner image receiving body 14*a* for cleaning. In addition to this, an AC voltage AC1 of, for example, 500 Hz to 10 kHz, and 100 $V_{p-p}$ to 1000 $V_{p-p}$, is preferably applied.

When a voltage lower than −1 kVDC is applied, the paper charging brush 450 tends to be stained, and when a voltage higher than −3 kVDC is applied, discharging occurs, resulting in damage to the paper charging brush 450 or the toner image receiving body 14*a*. Further, when an AC voltage is superposed, toner adhering prevention effects are increased.

During passage of the transfer material, during which the recording sheet P enters the toner image receiving body 14*a* after being aligned with the leading edge of the reverse surface image, and is in contact with the brush member 451 of the paper charging brush 450, a bias voltage BV2 of, for example, −500 VDC to −2 kVDC , shown in FIG. 21(*a*), with the same polarity as the toner (in the present example, negative polarity), is applied onto the paper charging brush 450. The driven roller 14*e* and the driving roller, (not shown), are electrically grounded. The recording sheet P charged to negative polarity, is attracted to the toner image receiving body 14*a* by positive charges, induced on the toner image receiving body 14*a* by the electrically grounded driven roller 14*e*, and by application of the bias voltage E1 with the negative polarity, which is the same polarity as the toner, onto the paper charger 150, and is conveyed.

When a voltage lower than −500 VDC is applied, the recording sheet P is insufficiently attracted to the toner image receiving body 14*a*. When a voltage higher than −2 kVDC is applied, there is a conspicuous tendency in which the toner image on the toner image receiving body 14*a* is disturbed by the electric charge injection during paper-charging.

During non-passage of the transfer material after the recording sheet P has passed the brush member 451 portion of the paper charging brush 450, a bias voltage BV2 of, for example, −100 VDC to −500 VDC with the same polarity as the toner, (in the present example, negative polarity), is applied to the paper charging brush 450. Due to this, toner adhesion to the paper charging brush 450 is prevented due to repulsion against the toner on the toner image receiving body 14*a*, and the toner adhered onto the paper charging brush 450 is adhered to the toner image receiving body 14*a*. In this case, the paper charging brush 450 may be in a floating condition. In addition, in order to increase the cleaning performance of the paper charging brush 450, it is preferable to superpose an AC voltage of 500 Hz to 10 kHz, and 100 $V_{p-p}$ to 1000 $V_{p-p}$, from an AC voltage source AC1.

When a voltage lower than −100 VDC is applied, the repulsion of toner by the applied voltage is not strong, and the tendency of toner adhering to the paper charging brush 450, becomes conspicuous. Further, when a voltage higher than −500 VDC is applied, damage occurs on the toner image receiving body 14*a* after a long period of use. When the AC voltage is superposed, effects of toner adhesion prevention are promoted.

Further, the same charging effect can also be obtained by another method of bias voltage application as follows. The transfer material charging means is electrically grounded, and a positive voltage, in which the polarity is reverse to toner and the voltage value is approximately the same as toner, is applied on the driven roller 14*e*.

In also the present example, when the blade member 141 of the toner image receiving body cleaning device 140 is released, the paper charging brush 450 is preferably positioned at least at the non-charging position. Further, in the same manner as the above-described Examples, the paper charging roller may also be used as the transfer material charging means.

Although the present invention has been described for a color image forming apparatus, the present invention can, of course, also be applied to a monochromatic image forming apparatus. Further, it is of course assumed that control timing should be appropriately adjusted, corresponding to the image formation size or the size of the transfer material.

Further, the present invention is not limited to the present system, but also includes variations by which double-sided images are formed. For example, the method in which processing conditions and image data processing conditions are changed with respect to the obverse surface and the reverse surface, as described above, can also be applied to the method, disclosed in Japanese Patent Publication No. 28740/1979, in which, relating to the reverse image, after the polarity of the toner has been reversed, images are simultaneously transferred onto both surfaces of the transfer material, and also for a tandem method, disclosed in Japanese Patent Publication Open to Public Inspection Nos. 180969/1988, 298255/1988, 44457/1989, etc., so that double-sided image formation in which the image density and the color tone are properly adjusted, can be carried out.

As described above, according to the present invention, toner adhered to the second image carrier means, does not adhere to the transfer material charging means, and toner staining of the transfer material charging means is prevented. Accordingly, excellent contact performance of the transfer material with the second image carrier means is maintained, so that excellent transfer material conveyance can be carried out.

Toner adhered to the second image carrier means is repulsed by the bias voltage, to be applied to the transfer material charging means, with the same polarity as the toner, and does not fly to the transfer material charging means, so that toner staining of the transfer material charging means is prevented.

The transfer material charging means does not directly come into contact with the second image carrier means, so that toner staining by the toner, adhered to the second image carrier means, is prevented.

Toner accumulation, formed on the second image carrier means at the time of release of the cleaning means for the second image carrier means, does not directly come into contact with the transfer material charging means, so that the toner stain of the transfer material charging means is prevented.

The toner adhered to the second image carrier means is repulsed by a bias voltage, with the same polarity as the toner, which is applied onto the transfer material charging means, so that the toner does not adhere to the transfer material charging means. Thereby, toner staining of the transfer material charging means is prevented, and excellent contact performance of the transfer material with the second image carrier means is maintained, so that excellent transfer material conveyance can be carried out.

Toner accumulation, formed on the second image carrier means at the time of release of the cleaning means from the second image carrier means, is repulsed by a bias voltage, with the same polarity as the toner, which is applied onto the transfer material charging means, so that the toner accumulation does not adhere to the transfer material charging means. Thereby, toner staining of the transfer material charging means is prevented.

What is claimed is:

1. An apparatus for forming an image on a sheet member, comprising:

first image carrying means for carrying images;

toner image forming means for forming a first toner image and a second toner image separately on the first image carrying means;

second image carrying means facing the first image carrying means for receiving the second toner image from the first image carrying means;

first transfer means for transferring the first toner image at a first transfer section from the first image carrying means to a first side of the sheet member;

second transfer means for transferring the second toner image at a second transfer section from the second image carrying means to a second side of the sheet member;

fixing means for fixing the first toner image onto the first side of the sheet member and the second toner image onto the second side of the sheet member; and cleaning means facing the second image carrying means for cleaning remaining toner, said cleaning means being provided at a cleaning section and being capable of being brought in contact with and separated from the second image carrying means, said cleaning means being brought in contact with the second image carrying means after the first toner image is transferred from the first image carrying means to the first side of the sheet members wherein the second image carrying means is rotatable in a rotating direction and has a circumferential length, wherein the sheet member has a longest possible length in the rotating direction, and wherein a partial circumferential length of the second image carrying means downstream in the rotating direction from the first transfer section to the cleaning section is longer than the longest possible length of the sheet member.

2. The apparatus of claim 1, wherein:

the second image carrying means has an entrance side and an exit side such that the sheet member is conveyed from the entrance side to the exit side on the second image carrying means, and the cleaning section is located at the entrance side of the second image carrying means.

3. The apparatus of claim 1, further comprising:

sheet member charging means for charging the sheet member as the sheet member proceeds to the second image carrying means, and wherein the first and second toner images on the first image carrying means have an electric polarity and the charging means charges the sheet member so as to have a same polarity as that of the first and second toner images.

4. An apparatus for forming an image on a sheet member, comprising:

first image carrying means for carrying images;

toner image forming means for forming a first toner image and a second toner image separately on the first image carrying means;

second image carrying means facing the first image carrying means for receiving the second toner image from the first image carrying means;

first transfer means for transferring the first toner image at a first transfer section from the first image carrying means to a first side of the sheet member;

second transfer means for transferring the second toner image at a second transfer section from the second image carrying means to a second side of the sheet member;

fixing means for fixing the first toner image onto the first side of the sheet member and the second toner image onto the second side of the sheet member; and cleaning means facing the second image carrying means for cleaning remaining toner, said cleaning means being provided at a cleaning section and being capable of being brought in contact with and separated from the second image carrying means, said cleaning means being brought in contact with the second image carrying means after the first toner image is transferred from the first image carrying means to the first side of the sheet member;

wherein the toner image forming means comprises exposure means for performing an imagewise exposure operation to form a latent image on the first image carrying means, and developing means for developing the latent image into the first and second toner images; and wherein the exposure means starts the imagewise exposure operation for a next sheet member after the cleaning means is brought in contact with the second image carrying means.

5. An apparatus for forming an image on a sheet member, comprising:

first image carrying means for carrying images;

toner image forming means for forming a first toner image and a second toner image separately on the first image carrying means;

second image carrying means facing the first image carrying means for receiving the second toner image from the first image carrying means;

first transfer means for transferring the first toner image at a first transfer section from the first image carrying means to a first side of the sheet member;

second transfer means for transferring the second toner image at a second transfer section from the second image carrying means to a second side of the sheet member;

fixing means for fixing the first toner image onto the first side of the sheet member and the second toner image onto the second side of the sheet member;

cleaning means facing the second image carrying means for cleaning remaining toner, said cleaning means being provided at a cleaning section and being capable of being brought in contact with and separated from the second image carrying means, said cleaning means being brought in contact with the second image carrying means after the first toner image is transferred from the first image carrying means to the first side of the sheet member; and sheet member charging means for charging the sheet member as the sheet member proceeds to the second image carrying means, wherein the sheet member charging means is moveable between (i) a charging position at which the sheet member charging means is brought in contact with the sheet member and charges the sheet members, and (ii) a non-charging position at which the sheet member charging means is separated from the sheet member, and wherein when the cleaning means is separated from the second image carrying means, the sheet member charging means is located at the non-charging position.

6. An apparatus for forming an image on a sheet member, comprising:

first image carrying means for carrying images;

toner image forming means for forming a first toner image and a second toner image separately on the first image carrying means;

second image carrying means facing the first image carrying means for receiving the second toner image from the first image carrying means;

first transfer means for transferring the first toner image at a first transfer section from the first image carrying means to a first side of the sheet member;

second transfer means for transferring the second toner image at a second transfer section from the second image carrying means to a second side of the sheet member;

fixing means for fixing the first toner image onto the first side of the sheet member and the second toner image onto the second side of the sheet member; and cleaning means facing the second image carrying means for cleaning remaining toner, said cleaning means being provided at a cleaning section and being capable of being brought in contact with and separated from the second image carrying means;

wherein the cleaning means is separated from the second image carrying means after the second toner image is received by the second image carrying means from the first image carrying means.

7. The apparatus of claim 6, further comprising:

a cleaning device located so as to face the first image carrying means, said cleaning device always being brought in contact with the first image carrying means.

8. The apparatus of claim 6, wherein the toner image forming means comprises:

exposure means for performing imagewise exposure operations so as to form latent images on the first image carrying means, and developing means for developing the latent images into the first and second toner images; and wherein the exposure means starts the imagewise exposure operations to form the first toner image after the cleaning means is separated from the second image carrying means.

9. The apparatus of claim 8, wherein:

the first image carrying means is rotatable in a rotating direction and has a circumferential length, and a partial circumferential length downstream in the rotating direction from the exposing section to the first transfer section is shorter than a partial circumferential length downstream in the rotating direction from a leading end of the second toner image on the second image carrying means to the first transfer section.

10. The apparatus of claim 8, wherein:

the first image carrying means is rotatable in a rotating direction and has a circumferential length, and a partial circumferential length downstream in the rotating direction from the exposing section to the first transfer section is shorter than a partial circumferential length downstream in the rotating direction from the cleaning section on the second image carrying means to the first transfer section.

11. The apparatus of claim 6, wherein:

the second image carrying means has an entrance side and an exit side such that the sheet member is conveyed from the entrance side to the exit side on the second image carrying means, and the cleaning section is located at the entrance side of the image carrying means.

12. The apparatus of claim 6, further comprising:

sheet member charging means for charging the sheet member as the sheet member proceeds to the second image carrying means, and wherein the first and second toner images on the first image carrying means have an electric polarity and the charging means charges the sheet member so as to have a same polarity as that of the first and second toner images.

13. The apparatus of claim 6, further comprising:

sheet member charging means for charging the sheet member as the sheet member proceeds to the second image carrying means, and wherein the sheet member charging means is moveable between (i) a charging position at which the sheet member charging means is brought in contact with the sheet member and charges the sheet member, and (ii) a non-charging position at which the sheet member charging means is separated from the sheet member.

14. An apparatus for forming a color image on a sheet member, comprising:

first image carrying means for carrying images, and being rotatable in a rotating direction ;

a plurality of exposing means provided around the first image carrying means for performing imagewise exposure operations to form latent images on the first image carrying means;

a plurality of developing means provided around the first image carrying means for developing the latent images so as to separately form a first color toner image and a second color toner image on the first image carrying means, each of said plurality of developing means having a different color toner which is successively superimposed on the first image carrying means during a single rotation of the first image carrying means;

second image carrying means facing the first image carrying means for receiving the second color toner image from the first image carrying means;

first transfer means for transferring the first color toner image at a first transfer section from the first image carrying means to a first side of the sheet member;

second transfer means for transferring the second color toner image at a second transfer section from the second image carrying means to a second side of the sheet member;

fixing means for fixing the first color toner image onto the first side of the sheet member and the second color toner onto the second side of the sheet member; and cleaning means facing the second image carrying means for cleaning remaining toner, said cleaning means being provided at a cleaning section and being capable of being brought in contact with and separated from the second image carrying means;

wherein a partial circumferential length of the second image carrying means upstream in the rotating direction from the first transfer section to the cleaning section is longer than a partial circumferential length of the first image carrying means upstream in the rotating direction from the first transfer section to a first exposing section of a first one of the plurality of exposing means which is located nearest to the first transfer section, wherein the partial circumferential length of the second image carrying means upstream in the rotating direction from the first transfer section to the cleaning section is shorter than a partial circumferential length of the first image carrying means upstream in the rotating direction from the first transfer section to a second exposing section of a second one of the plurality of exposing means which is located farthest from the first transfer section, and wherein the cleaning means is not actuated to be brought in contact with or separated from the second image carrying means during the exposure operations of the plurality of exposing means.

15. The apparatus of claim 14, wherein the cleaning means is brought in contact with the second image carrying means before a first exposure operation of the plurality of exposing means is performed with respect to the second color toner image.

16. The apparatus of claim 14, wherein the cleaning means is separated from the second image carrying means after a final exposure operation of the plurality of exposing means is completed with respect to the second color toner image.

17. The apparatus of claim 14, wherein the cleaning means is separated from the second image carrying means before a first exposure operation of the plurality of exposing means is performed with respect to the first color toner image.

18. The apparatus of claim 14, wherein the cleaning means is brought in contact with the second image carrying means after a final exposure operation of the plurality of exposing means is completed with respect to the first color toner image.

19. The apparatus of claim 14, further comprising:

sheet member charging means for charging the sheet member as the sheet member proceeds to the second image carrying means, wherein the sheet member charging means is moveable between (i) a charging position at which the sheet member charging means is brought in contact with the sheet member and charges the sheet member, and (ii) a non-charging position at which the sheet member charging means is separated from the sheet member, and wherein when the cleaning means is separated, and wherein when the cleaning means is separated from the second image carrying means, the sheet member charging means is located at the non-charging position.

20. An apparatus for forming an image on a sheet member, comprising:

first image carrying means for carrying images, and being rotatable in a rotating direction;

exposing means for performing imagewise exposure operations at an exposing section to form latent images on the first image carrying means;

developing means for developing the latent images so as to separately form a first toner image and a separate toner image on the first image carrying means;

second image carrying facing the first image carrying means for receiving the second toner image from the first image carrying means;

first transfer means for transferring the first toner image at a first transfer section from the first image carrying means to a first side of the sheet member;

second transfer means for transferring the second toner image at a second transfer section from the second image carrying means to a second side of the sheet member;

fixing means for fixing the first toner image onto the first side of the sheet member and the second toner onto the second side of the sheet member; and cleaning means facing the second image carrying means at a cleaning section for cleaning remaining toner, said cleaning means being capable of being brought in contact with and separated from the second image carrying means;

wherein a partial circumferential length of the second image carrying means upstream in the rotating direction from the first transfer section to the cleaning section is longer than a partial circumferential length of the first image carrying means upstream in the rotating direction from the first transfer section to the exposing section, wherein the cleaning means is not actuated to be brought in contact with or separated from the second image carrying means during the exposure operations of the image exposing means, and wherein the cleaning means is brought in contact with the second image carrying means before a first exposure operation of the exposing means is performed with respect to the second toner image.

21. An apparatus for forming an image on a sheet member, comprising:

first image carrying means for carrying images, and being rotatable in a rotating direction;

exposing means for performing imagewise exposure operations at an exposing section to form latent images on the first image carrying means;

developing means for developing the latent images so as to separately form a first toner image and a separate toner image on the first image carrying means;

second image carrying facing the first image carrying means for receiving the second toner image from the first image carrying means;

first transfer means for transferring the first toner image at a first transfer section from the first image carrying means to a first side of the sheet member;

second transfer means for transferring the second toner image at a second transfer section from the second image carrying means to a second side of the sheet member;

fixing means for fixing the first toner image onto the first side of the sheet member and the second toner onto the second side of the sheet member; and cleaning means facing the second image carrying means at a cleaning section for cleaning remaining toner, said cleaning means being capable of being brought in contact with and separated from the second image carrying means;

wherein a partial circumferential length of the second image carrying means upstream in the rotating direction from the first transfer section to the cleaning section is longer than a partial circumferential length of the first image carrying means upstream in the rotating direction from the first transfer section to the exposing section, wherein the cleaning means is not actuated to be brought in contact with or separated from the second image carrying means during the exposure operations of the image exposing means, and wherein the cleaning means is separated from the second image carrying means after a final exposure operation of the exposing means is completed with respect to the second toner image.

22. An apparatus for forming an image on a sheet member, comprising:

first image carrying means for carrying images, and being rotatable in a rotating direction;

exposing means for performing imagewise exposure operations at an exposing section to form latent images on the first image carrying means;

developing means for developing the latent images so as to separately form a first toner image and a separate toner image on the first image carrying means;

second image carrying facing the first image carrying means for receiving the second toner image from the first image carrying means;

first transfer means for transferring the first toner image at a first transfer section from the first image carrying means to a first side of the sheet member;

second transfer means for transferring the second toner image at a second transfer section from the second image carrying means to a second side of the sheet member;

fixing means for fixing the first toner image onto the first side of the sheet member and the second toner onto the second side of the sheet member; and cleaning means facing the second image carrying means at a cleaning section for cleaning remaining toner, said cleaning means being capable of being brought in contact with and separated from the second image carrying means;

wherein a partial circumferential length of the second image carrying means upstream in the rotating direction from the first transfer section to the cleaning section is longer than a partial circumferential length of the first image carrying means upstream in the rotating direction from the first transfer section to the exposing section, wherein the cleaning means is not actuated to be brought in contact with or separated from the second image carrying means during the exposure operations of the image exposing means, and wherein the cleaning means is brought in contact with the second image carrying means after a final exposure operation of the exposing means is completed with respect to the first toner image.

23. An apparatus for forming an image on a sheet member, comprising:

first image carrying means for carrying images, and being rotatable in a rotating direction;

exposing means for performing imagewise exposure operations at an exposing section to form latent images on the first image carrying means;

developing means for developing the latent images so as to separately form a first toner image and a separate toner image on the first image carrying means;

second image carrying facing the first image carrying means for receiving the second toner image from the first image carrying means;

first transfer means for transferring the first toner image at a first transfer section from the first image carrying means to a first side of the sheet member;

second transfer means for transferring the second toner image at a second transfer section from the second image carrying means to a second side of the sheet member;

fixing means for fixing the first toner image onto the first side of the sheet member and the second toner onto the second side of the sheet member; and cleaning means facing the second image carrying means at a cleaning section for cleaning remaining toner, said cleaning means being capable of being brought in contact with and separated from the second image carrying means;

wherein a partial circumferential length of the second image carrying means upstream in the rotating direction from the first transfer section to the cleaning section is longer than a partial circumferential length of the first image carrying means upstream in the rotating direction from the first transfer section to the exposing section, wherein the cleaning means is not actuated to be brought in contact with or separated from the second image carrying means during the exposure operations of the image exposing means, and wherein, on a condition that the cleaning means is brought in contact with the second image carrying means, after a certain point on the second image carrying means moves over a distance corresponding to a length obtained by subtracting the partial circumferential length of the first image carrying means upstream in the rotating direction from the first transfer section to the exposing section from the partial circumferential length of the second image carrying means upstream in the rotating direction from the first transfer section to the cleaning section, the exposing means starts an exposure operation with respect to the second toner image.

24. An apparatus for forming an image on a sheet member, comprising:

first image carrying means for carrying images, and being rotatable in a rotating direction;

exposing means for performing imagewise exposure operations at an exposing section to form latent images on the first image carrying means;

developing means for developing the latent images so as to separately form a first toner image and a separate toner image on the first image carrying means;

second image carrying facing the first image carrying means for receiving the second toner image from the first image carrying means;

first transfer means for transferring the first toner image at a first transfer section from the first image carrying means to a first side of the sheet member;

second transfer means for transferring the second toner image at a second transfer section from the second image carrying means to a second side of the sheet member;

fixing means for fixing the first toner image onto the first side of the sheet member and the second toner onto the second side of the sheet member; and cleaning means facing the second image carrying means at a cleaning section for cleaning remaining toner, said cleaning means being capable of being brought in contact with and separated from the second image carrying means;

wherein a partial circumferential length of the second image carrying means upstream in the rotating direction from the first transfer section to the cleaning section is longer than a partial circumferential length of the first image carrying means upstream in the rotating direction from the first transfer section to the exposing section, wherein the cleaning means is not actuated to be brought in contact with or separated from the second image carrying means during the exposure operations of the image exposing means, and wherein said apparatus further comprises a sheet member charging means for charging sheet member as the sheet member proceeds to the second image carrying means, wherein the sheet member charging means is moveable between (i) a charging position at which the sheet member charging means is brought in contact with the sheet member and charges the sheet member, and (ii) a non-charging position at which the sheet member charging means is separated from the sheet member, and wherein when the cleaning means is separated from the second image carrying means, the sheet member charging means is located at the non-charging position.

* * * * *